US005682502A

United States Patent [19]

Ohtsuka et al.

[11] Patent Number: 5,682,502

[45] Date of Patent: Oct. 28, 1997

[54] SYLLABLE-BEAT-POINT SYNCHRONIZED RULE-BASED SPEECH SYNTHESIS FROM CODED UTTERANCE-SPEED-INDEPENDENT PHONEME COMBINATION PARAMETERS

[75] Inventors: Mitsuru Ohtsuka; Yasunori Ohora; Takashi Asou, all of Yokohama; Takeshi Fujita, Tokushima-ken; Toshiaki Fukada, Yohohama, all of Japan

[73] Assignee: Canon Kabushiki Kaisha, Tokyo, Japan

[21] Appl. No.: 490,140

[22] Filed: Jun. 14, 1995

[30] Foreign Application Priority Data

Jun. 16, 1994 [JP] Japan ..... 6-134363

[51] Int. Cl.[6] ..... G10L 5/04

[52] U.S. Cl. ..... 395/2.76; 395/2.69

[58] Field of Search ..... 395/2.69, 2.76

[56] References Cited

U.S. PATENT DOCUMENTS

| | | | |
|---|---|---|---|
| 4,435,832 | 3/1984 | Asada et al. | 395/2.71 |
| 4,611,342 | 9/1986 | Miller et al. | 395/2.34 |
| 5,220,629 | 6/1993 | Kosaka et al. | 395/2.69 |
| 5,381,514 | 1/1995 | Aso et al. | 395/2.73 |

FOREIGN PATENT DOCUMENTS

| | | | |
|---|---|---|---|
| 0351848 | 1/1990 | European Pat. Off. | 395/2.74 |

OTHER PUBLICATIONS

Jonathan Allen, "Overview of Text–to–Speech Systems", in Advances in Speech Signal Processing, edited by Sadaoki Furui and M. Mohan Sondhi, Marcel Dekker, Inc., chapter 23, pp. 741–790 1992.

Hirokazu Sato, "Speech Synthesis for Text–to–Speech Systems", in Advances in Speech Signal Processing, edited by Sadaoki Furui and M. Mohan Sondhi, Marcel Dekker, Inc., chapter 25, pp. 833–853 1992.

Chris Rowden , "Synthesis", in Speech Processing, edited by Chris Rowden, McGraw–Hill Book Company, chapter 6, pp. 184–222 1992.

*Primary Examiner*—Allen R. MacDonald
*Assistant Examiner*—Tālivaldis Ivars Šmits
*Attorney, Agent, or Firm*—Fitzpatrick, Cella, Harper & Scinto

[57] ABSTRACT

In a speech synthesizer, each frame for generating a speech waveform has an expansion degree to which the frame is expanded or compressed in accordance with the production speed of synthetic speech. In accordance with the set speech production speed, the time interval between beat synchronization points is determined on the basis of the speed of the speech to be produced, and the time length of each frame present between the beat synchronization points is determined on the basis of the expansion degree of the frame. Parameters for producing a speech waveform in each frame are properly generated by the time length determined for the frame. In the speech synthesizer for outputting a speech signal by coupling phonemes constituted by one or a plurality of frames having phoneme vowel-consonant combination parameters (VcV, cV, or V) of the speech waveform, the number of frames can be held constant regardless of a change in the speech production speed. This prevents degradation in the tone quality or a variation in the processing quantity resulting from a change in the speech production speed.

36 Claims, 30 Drawing Sheets

• TIME LENGTH IS IN UNITS OF SAMPLE NUMBERS

FIG. 6

DATA STRUCTURE OF ONE FRAME OF PARAMETER

| | |
|---|---|
| vowelflag | VOWEL STATIONARY PART FLAG |
| voweltype | TYPE OF VOWEL |
| $\alpha$ | PHONEME TIME LENGTH COEFFICIENT |
| plen | TIME LENGTH BEFORE EXPANSION OR COMPRESSION |
| K | SPEECH PRODUCTION SPEED COEFFICIENT |
| accMora | ACCENT MORA |
| accLevel | ACCENT LEVEL |
| uvflag | VOICED · UNVOICED INFORMATION |
| c [0] ~ c [M] | SYNTHETIC PARAMETER |

FIG. 15

DATA STRUCTURE OF ONE FRAME OF PARAMETER

| | |
|---|---|
| vowelflag | VOWEL STATIONARY PART FLAG |
| voweltype | TYPE OF VOWEL |
| $\alpha$ | PHONEME TIME LENGTH COEFFICIENT |
| plen | TIME LENGTH BEFORE EXPANSION OR COMPRESSION |
| K | SPEECH PRODUCTION SPEED COEFFICIENT |
| uvflag | VOICED · UNVOICED INFORMATION |
| pitch | PITCH SCALE |
| c [0] ~ c [M] | SYNTHETIC PARAMETER |

SYLLABLE-BEAT-POINT SYNCHRONIZED RULE-BASED SPEECH SYNTHESIS FROM CODED UTTERANCE-SPEED-INDEPENDENT PHONEME COMBINATION PARAMETERS

BACKGROUND OF THE INVENTION

The present invention relates to a speech synthesis method and a speech synthesizer using a rule-based synthesis method.

A general rule-based speech synthesizer synthesizes a digital speech signal by coupling a phoneme, which has a VcV parameter (vowel-consonant-vowel) or a cV parameter (consonant-vowel) as a basic unit, and a driving sound source signal in accordance with a predetermined rule, and forms an analog speech waveform by performing D-A conversion on the digital speech signal. The synthesizer then passes the analog speech signal through an analog low-pass filter to remove unnecessary high-frequency noise components generated by sampling, thereby outputting a correct analog speech waveform.

The above conventional speech synthesizer usually employs a method illustrated in FIG. 1 as a means for changing the speech production speed.

Referring to FIG. 1, (A1) is a speech waveform before the VcV parameter is extracted, which represents a portion of speech "A·SA". Similarly, (A2) represents a portion of speech "A·KE" (B1) represents the VcV parameter of the speech waveform information of (A1); and (B2), the VcV parameter of the speech waveform information of (A2). (B3) represents a parameter having a length which is determined by, e.g., the interval between beat synchronization points and the type of vowel. The parameter (B3) interpolates the parameters before and after the coupling. The beat synchronization point is included in the label information of each VcV parameter. Each rectangular portion in (B1) to (B3) represents a frame, and each frame has a parameter for generating a speech waveform. The time length of each frame is fixed.

(C1) is label information corresponding to (A1) and (B1), which indicates the positions of acoustic boundaries between parameters. Likewise, (C2) is label information corresponding to (A2) and (B2). Labels "?" in FIG. 1 correspond to the positions of beat synchronization points. The production speed of synthetic speech is determined by the time interval between these beat synchronization points.

(D) represents the state in which parameter information (frames) corresponding to a portion from the beat synchronization point in (C1) to the beat synchronization point in (C2) are extracted from (B1), (B2), and (B3) and coupled together. (E) represents label information corresponding to (D). (F) indicates expansion degrees set between the neighboring labels, each of which is a relative degree when the parameter of (D) is expanded or compressed in accordance with the beat synchronization point interval in the synthetic speech. (G) represents a parameter string, or a frame string, after being expanded or compressed according to the beat synchronization point interval in the synthetic speech. (H) indicates label information corresponding to (G).

As described above, the speech production speed is changed by expanding or compressing the interval between beat synchronization points. This expansion or compression of the interval between beat synchronization points is accomplished by increasing or decreasing the number of frames between the beat synchronization points, since the time length of each frame is fixed. As an example, the number of frames is increased when the beat synchronization point interval is expanded as indicated by (G) in FIG. 1. A parameter of each frame is generated by an arithmetic operation in accordance with the number of necessary frames.

The prior art described above has the following problems since the number of frames is changed in accordance with the production speed of synthetic speech. That is, in expanding or compressing the parameter string of (D) into that of (G), if the parameter string of (G) becomes shorter than that of (D), the number of frames is decreased. Consequently, the parameter interpolation becomes coarse, and this sometimes results in an abnormal tone or degradation in the tone quality.

In addition, if the speech production speed is extremely lowered, the length of the parameter string of (G) is overly increased to increase the number of frames. This prolongs the calculation time required for calculating the parameters and also increases the required capacity of a memory. Furthermore, after the parameter string of (G) is generated it is not possible to change the speech production speed of that parameter string. Consequently, a time delay is produced with respect to a change of the speech production time designated by the user. This gives the user a sense of incompatibility.

SUMMARY OF THE INVENTION

The present invention has been made in consideration of the above conventional problems and has its object to provide a speech synthesis method and a speech synthesizer which can maintain the number of frames constant with respect to a change in the production speed of synthetic speech, thereby preventing degradation in the tone quality at high speeds and suppressing a drop of the processing speed and an increase in the required capacity of a memory at low speeds.

It is another object of the present invention to provide a speech synthesis method and a speech synthesizer which can change speech speeds to be produced in units of frames and thereby can operate in accordance with a change in the speech production speed even during one mora period.

It is still another object of the present invention to provide a speech synthesis method and a speech synthesizer in which the pitch scale is so set that the level of an accent of synthesized speech linearly changes during a predetermined period (e.g., one mora period).

It is still another object of the present invention to provide a speech synthesis method and a speech synthesizer in which the pitch scale is so set that the pitch of a tone of synthesized speech linearly changes during a predetermined period (e.g., one molar period).

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 6 is a view showing the data structure of one frame of a parameter in the first embodiment;

FIG. 15 is a view showing the data structure of one frame of a parameter in the second embodiment;

DETAILED DESCRIPTION OF THE PREFERRED EMBODIMENTS

Preferred embodiments of the present invention will now be described in detail in accordance with the accompanying drawings.

First Embodiment

Figure 2:
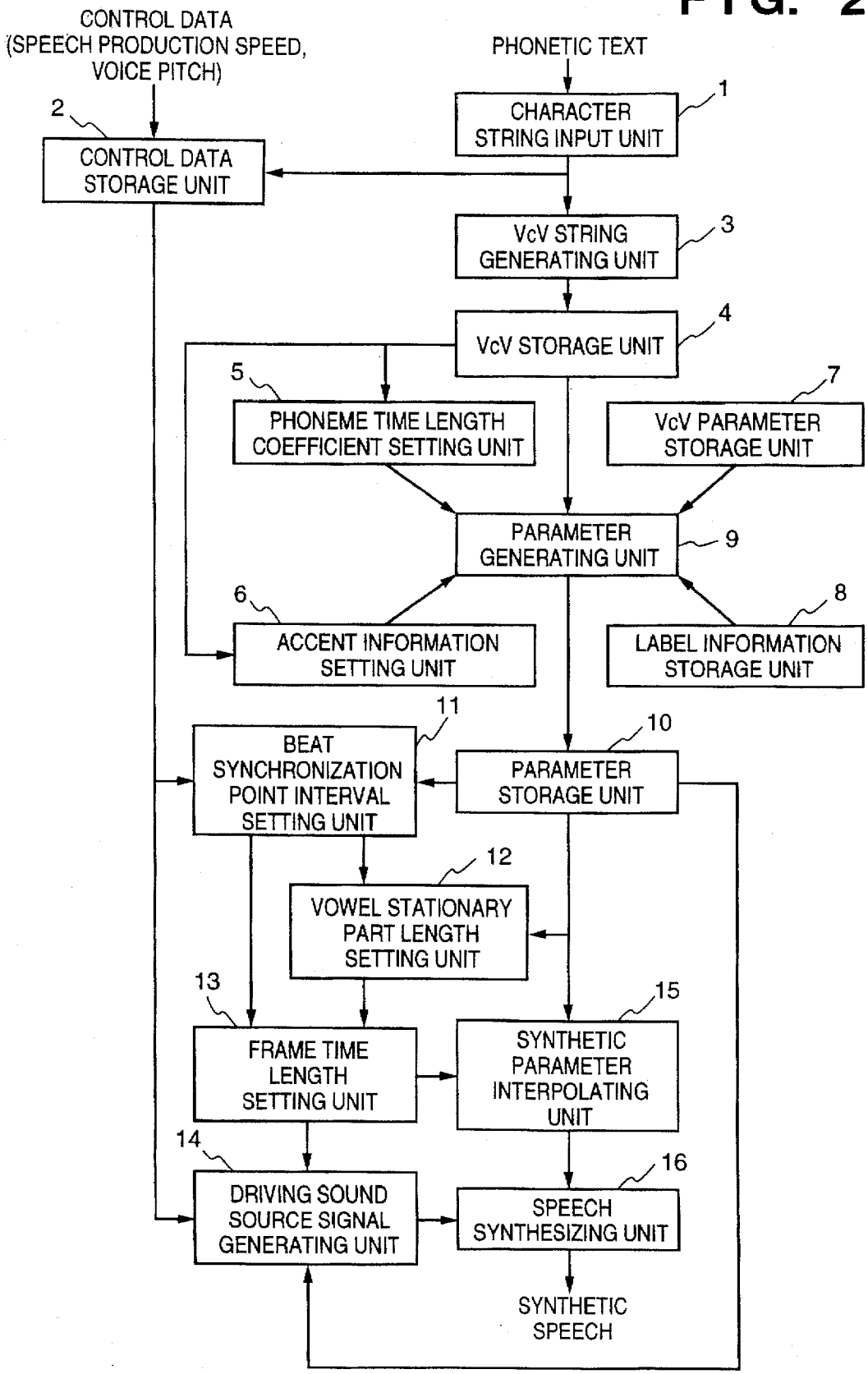
FIG. 2 is a block diagram showing the configuration of functional blocks of a speech synthesizer according to the first embodiment.

FIG. 2 is a block diagram showing the arrangement of functional blocks of a speech synthesizer according to the first embodiment. A character string input unit 1 inputs a character string of speech to be synthesized. For example, if the speech to be synthesized is "O·N·SE·I", the character string input unit 1 inputs a character string "OnSEI". This character string sometimes contains, e.g., a control sequence for setting the speech production speed or the pitch of a voice. A control data storage unit 2 stores, in internal registers, information which is found to be a control sequence by the character string input unit 1 and control data for the speech production speed and the pitch of a voice input from a user interface. A VcV string generating unit 3 converts the input character string from the character string input unit 1 into a VcV string. As an example, the character string "OnSEI" is converted into a VcV string "QO, On, nSE, EI, IQ".

A VcV storage unit 4 stores the VcV string generated by the VcV string generating unit 3 into internal registers. A phoneme time length coefficient setting unit 5 stores a value which represents the degree to which a beat synchronization point interval of synthetic speech is to be expanded from a standard beat synchronization point interval in accordance with the type of VcV stored in the VcV storage unit 4. An accent information setting unit 6 sets accent information of the VcV string stored in the VcV storage unit 4. A VcV parameter storage unit 7 stores VcV parameters corresponding to the VcV string generated by the VcV string generating unit 3, or a V (vowel) parameter or a cV parameter which is the data at the beginning of a word. A label information storage unit 8 stores labels for distinguishing the acoustic boundaries between a vowel start point, a voiced section, and an unvoiced section, and labels indicating beat synchronization points, for each VcV parameter stored in the VcV parameter storage unit 7, together with the position information of these labels. A parameter generating unit 9 generates a parameter string corresponding to the VcV string generated by the VcV string generating unit 3. The procedure of the parameter generating unit 9 will be described later.

A parameter storage unit 10 extracts parameters in units of frames from the parameter generating unit 9 and stores the parameters in internal registers. A beat synchronization point interval setting unit 11 sets the standard beat synchronization point interval of synthetic speech from the control data for the speech production speed stored in the control data storage unit 2. A vowel stationary part length setting unit 12 sets the time length of a vowel stationary part pertaining to the connection of VcV parameters in accordance with a type of vowel or the like factor. A frame time length setting unit 13 calculates the time length of each frame in accordance with the speech production speed coefficient of the parameter, the beat synchronization point interval set by the beat synchronization point interval setting unit 11, and the vowel stationary part length set by the vowel stationary part length setting unit 12. Reference numeral 14 denotes a driving sound source signal generating unit. The procedure of this driving sound source signal generating unit 14 will be described later.

A synthetic parameter interpolating unit 15 interpolates the parameters stored in the parameter storage unit by using the frame time length set by the frame time length setting unit 13. A speech synthesizing unit 16 generates synthetic speech from the parameters interpolated by the synthetic parameter interpolating unit 15 and the driving sound source signal generated by the driving sound source signal generating unit 14.

Figure 1:
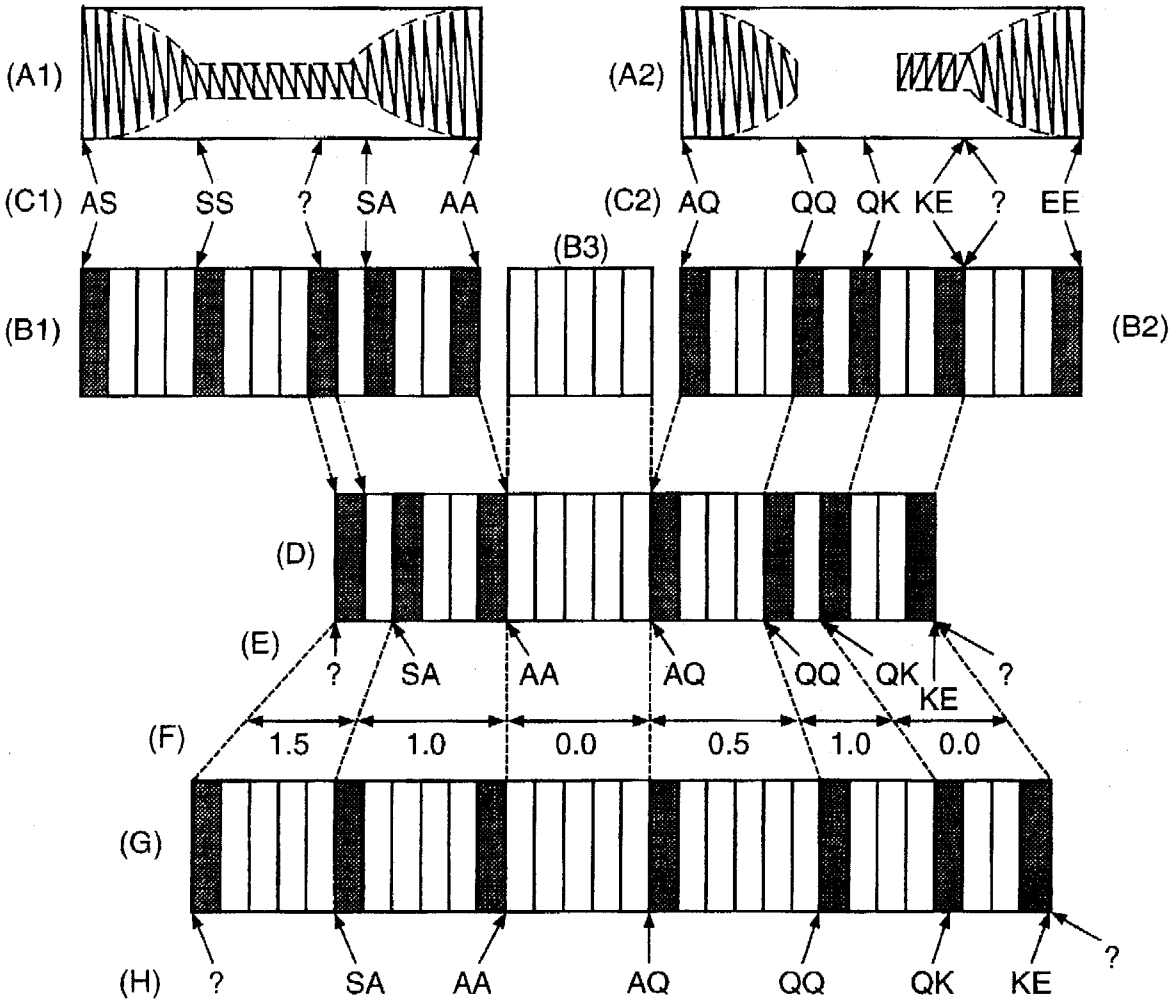
FIG. 1 is a view for explaining the general procedure of speech synthesis using VcV parameters.
Figure 3:
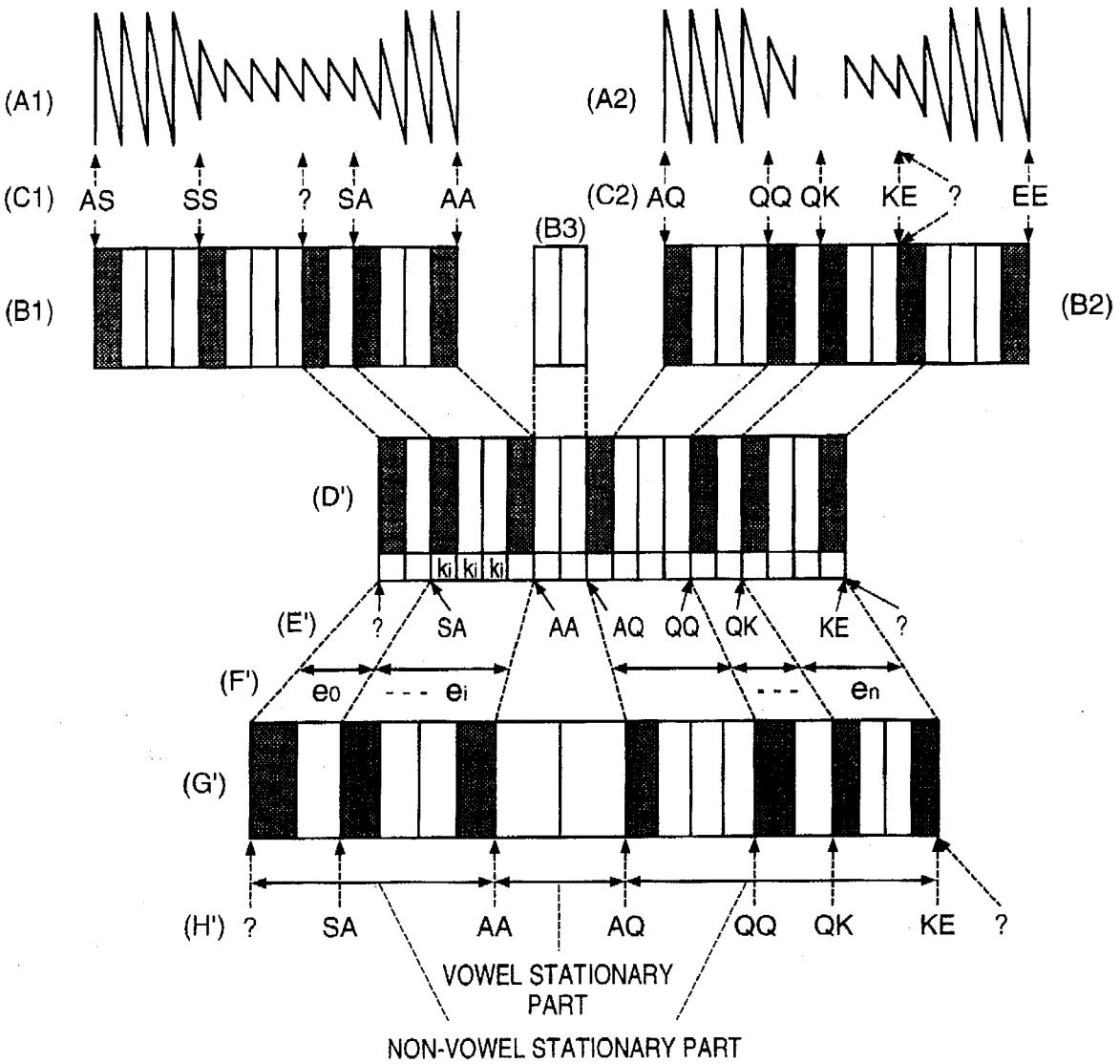
FIG. 3 is a view for explaining the procedure of speech synthesis using VcV parameters in the first embodiment.

FIG. 3 illustrates one example of speech synthesis using VcV parameters as phonemes. Note that the same reference numerals as in FIG. 1 denote the same parts in FIG. 3, and a detailed description thereof will be omitted.

Referring to FIG. 3, VcV parameters (B1) and (B2) are stored in the VcV parameter storage unit 7. A parameter (B3) is the parameter of a vowel stationary part, which is generated by the parameter generating unit 9 from the information stored in the VcV parameter storage unit 7 and the label information storage unit 8. Label information, (C1) and (C2), of the individual parameters are stored in the label information storage unit 8. (D') is a frame string formed by extracting parameters corresponding to a portion from the position of the beat synchronization point in (C1) to the position of the beat synchronization point in (C2) from (B1), (B3), and (B2), and connecting these parameters.

Each frame in (D') is further added to an area for storing a speech production speed coefficient $K_i$. (E') is label information corresponding to (D'). (F') indicates expansion degrees set in accordance with the types of neighboring labels. (G') is the result of interpolation performed by the synthetic parameter interpolating unit 15 for each frame in (D') by using the time length set by the frame time length setting unit 13. The speech synthesizing unit 16 generates synthetic speech in accordance with the parameter (G').

Figure 4:
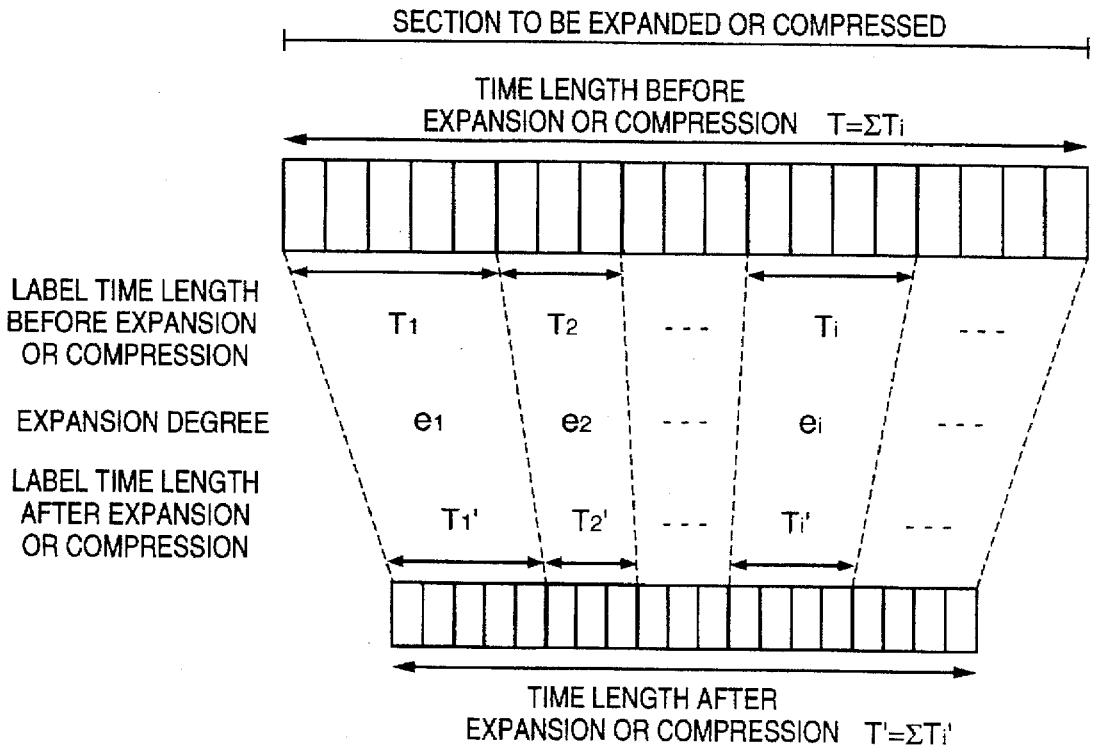
FIG. 4 is a view for explaining the expansion or compression of a VcV parameter in the first embodiment.

Expansion or compression of the VcV parameter will be described in detail below with reference to FIG. 4. Assuming the expansion degree of the ith label is $e_i$, the label time length, $T_i$, before expansion or compression and the label time length, $T'_i$, after expansion or compression hold the following relation:

$$(T_1-T'_1)/T_1:(T_2-T'_2)/T_2:\cdots(T_i-T'_i)/T_i\cdots=e_1:e_2:\cdots e_i:\cdots \quad (1)$$

where the time length is in units of sample numbers.

Assume that the product sum (expansion/compression frame product sum) of the expansion degree and the label time length before expansion or compression is $$\sigma=\Sigma e_i T_i,$$

that the difference (the time length difference) between the time lengths before and after expansion or compression is $$\delta=T'-T=-\Sigma(T_i-T'_i),$$

and that the speech production speed coefficient is $$K_i=e_i/\sigma.$$

Equation (1) is rewritten as follows:

$$T_1-T'_1:T_2-T'_2:\cdots T_i-T'_i:\cdots=e_1T_1:e_2T_2:\cdots e_iT_i:\cdots \quad (2)$$

$$(T_i-T'_i)/\delta=e_iT_i/\sigma$$

$$T'_i/T_i=(e_i/\sigma).\delta+1$$

$$T'_i/T_i=K_i.\delta+1$$

If the standard time length of one frame is N samples (120 samples for 12-kHz sampling), the synthetic parameter of the ith label is interpolated with $n_i$ samples per frame. In this case $n_i$ is represented by Equation (3) below:

$$n_i=(T'_i/T_i).N=(K_i\cdot\delta+1).N \quad (3)$$

Since the only value determined according to the speech production speed is T', it is possible to change the speech production speed in units of frames using Equation (3) by giving the speech production speed coefficient $K_i$ as the parameter of each frame.

Figure 5:
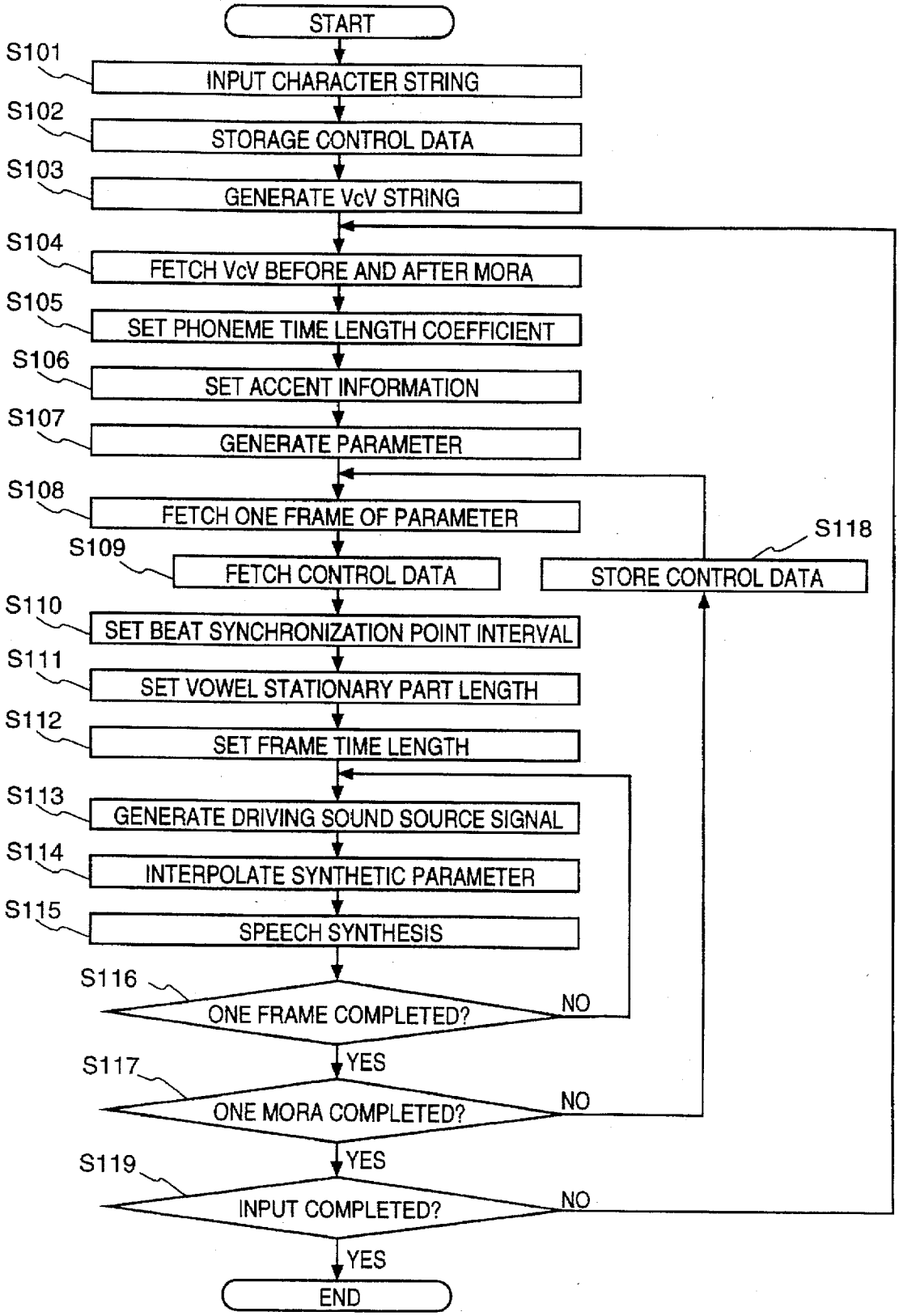
FIG. 5 is a flow chart showing the speech synthesis procedure in the first embodiment.

The above operation will be described below with reference to the flow chart in FIG. 5.

In step S101, the character string input unit 1 inputs a phonetic text. In step S102, the control data storage unit 2 stores externally input control data (the speech production speed, the pitch of a voice) and the control data contained in the input phonetic text. In step S103, the VcV string generating unit 3 generates a VcV string from the input phonetic text from the character string input unit 1.

In step S104, the VcV storage unit 4 fetches VcV parameters before and after a mora. In step S105, the phoneme time length coefficient setting unit 5 sets a phoneme time length in accordance with the types of VcV parameters before and after the mora.

Figure 7:
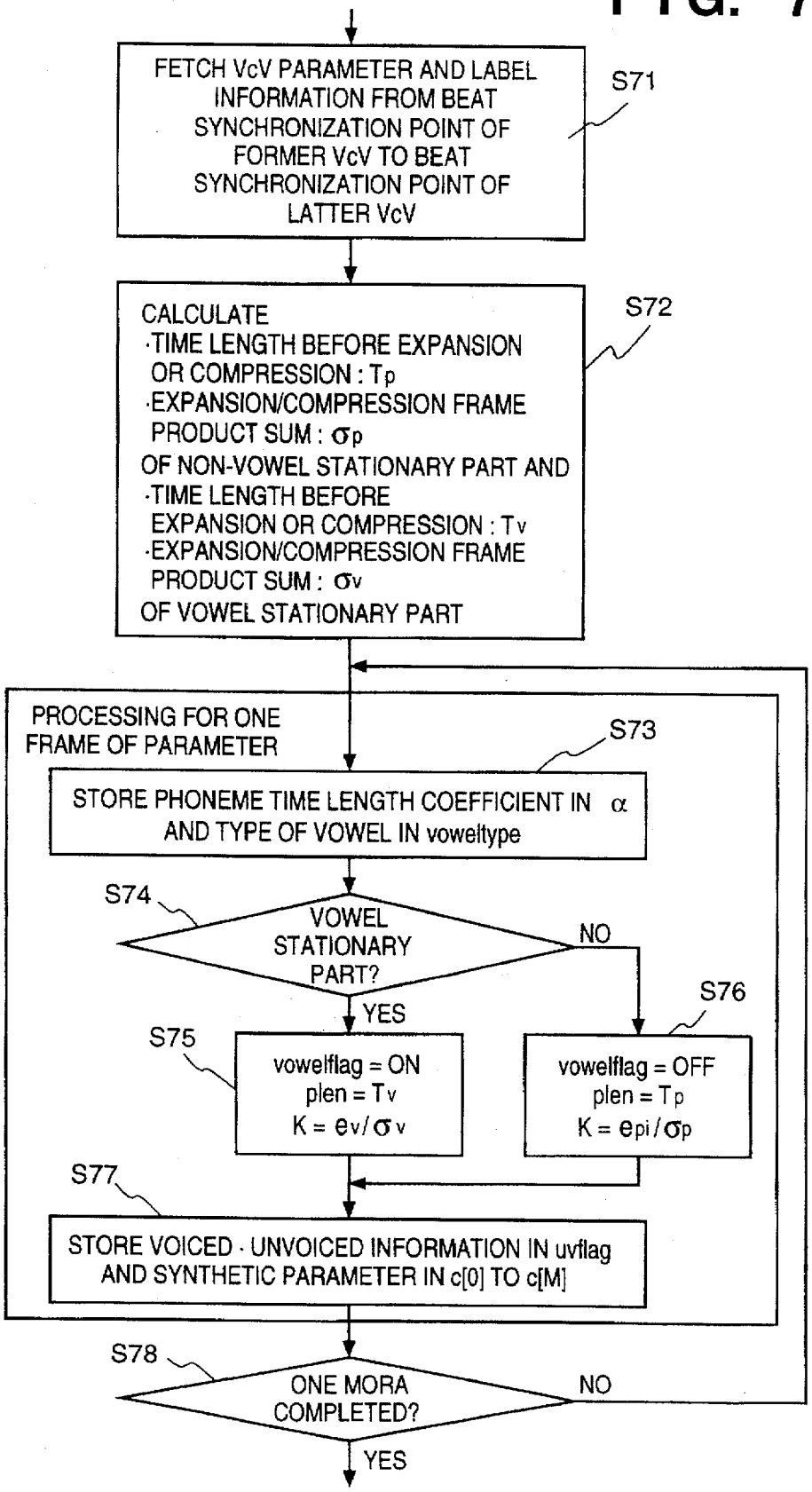
FIG. 7 is a flow chart showing the parameter generation procedure in the first embodiment.

FIG. 6 shows the data structure of one frame of a parameter. FIG. 7 is a flow chart which corresponds to step S107 in FIG. 5 and illustrates the parameter generation procedure performed by the parameter generating unit 9. A vowel stationary part flag vowelflag indicates whether the parameter is a vowel stationary part. This parameter vowelflag is set in step S75 or S76 of FIG. 7. A parameter voweltype, which represents the type of vowel, is used in a calculation of the vowel stationary part length. This parameter is set in step S73. Voiced·unvoiced information uvflag indicates whether the phoneme is voiced or unvoiced. This parameter is set in step S77.

In step S106, the accent information setting unit 6 sets accent information. An accent mora accMora represents the number of moras from the beginning to the end of an accent. An accent level accLevel indicates the level of accent in a pitch scale. The accent information described in the phonetic text is stored in these parameters.

In step S107, the parameter generating unit 9 generates a parameter string of one mora by using the phoneme time length coefficient set by the phoneme time length coefficient setting unit 5, the accent information set by the accent information setting unit 6, the VcV parameter fetched from the VcV parameter storage unit 7, and the label information fetched from the label information storage unit 8.

In step S71, a VcV parameter of one mora (from the beat synchronization point of the former VcV to the beat synchronization point of the latter VcV) is fetched from the VcV parameter storage unit 7, and the label information of that mora is fetched from the label information storage unit 8.

Figure 8:
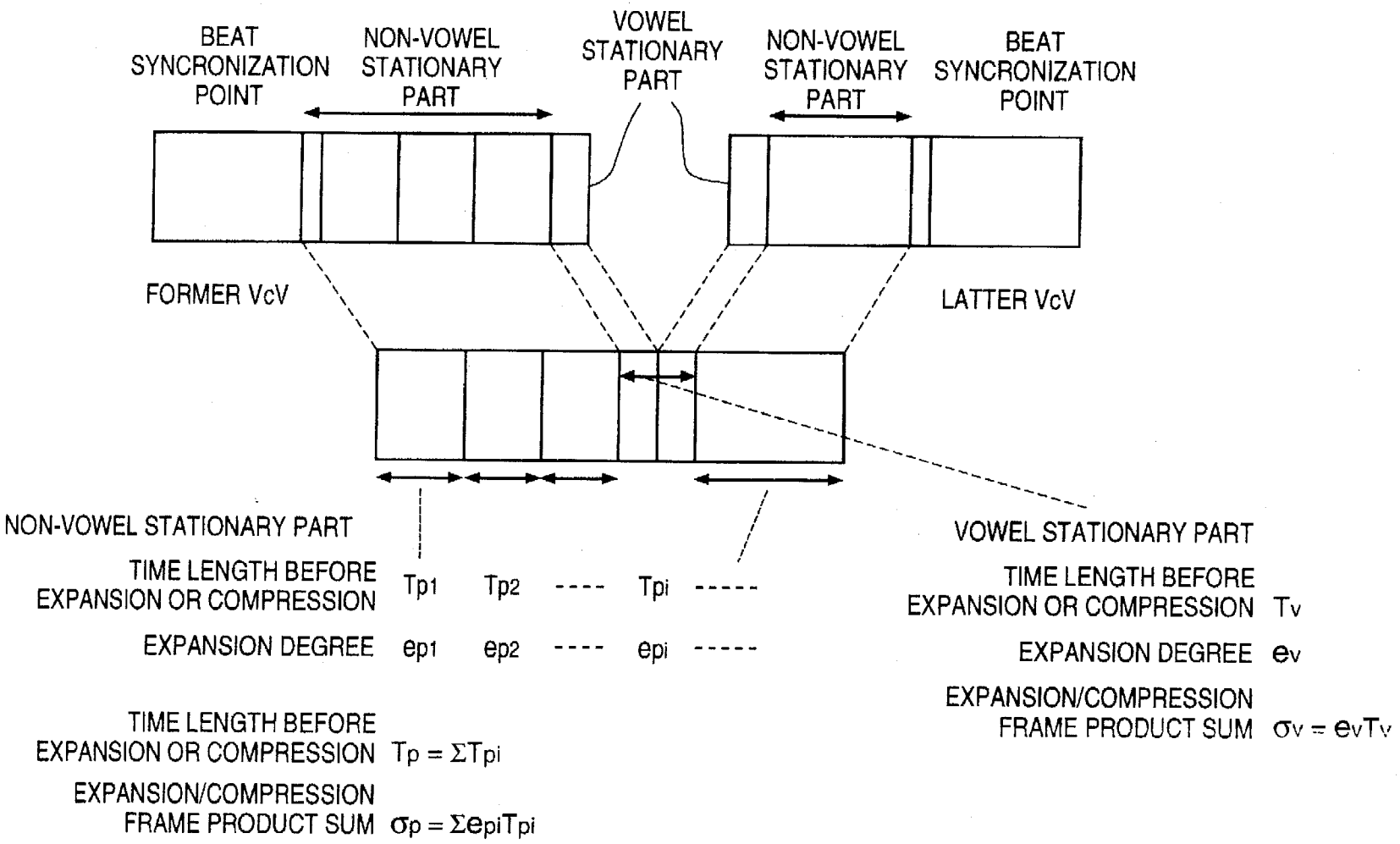
FIG. 8 is a view for explaining the generation of a parameter in the first embodiment.

In step S72, the fetched VcV parameter is divided into a non-vowel stationary part and a vowel stationary part, as illustrated in FIG. 8. A time length $T_p$ before expansion or compression and an expansion/compression frame product sum $s_p$ of the non-vowel stationary part and a time length $T_v$ before expansion or compression and an expansion or compression frame product sum $s_v$ of the vowel stationary part are calculated.

Subsequently, the flow proceeds on to the processing for each frame of the parameter (steps S73 to S77). In step S73, the phoneme time length coefficient is stored in a, and the vowel type is stored in voweltype.

In step S74, whether the parameter is a vowel stationary part is checked. If the parameter is a vowel stationary part, in step S75 the vowel stationary part flag is turned on and the time length before expansion or compression and the speech production speed coefficient of the vowel stationary part are set. If the parameter is a non-vowel stationary part, in step S76 the vowel stationary part flag is turned off and the time length before expansion or compression and the speech production speed coefficient of the nonvowel stationary part are set.

In step S77, the voiced-unvoiced information and the synthetic parameter are stored. If the processing for one mora is completed in step S78, the flow advances to step S108. If the one-mora processing is not completed in step S78, the flow returns to step S73 to repeat the above processing.

In step S108, the parameter storage unit 10 fetches one frame of the parameter from the parameter generating unit 9. In step S109, the beat synchronization point interval setting unit 11 fetches the speech production speed from the control data storage unit 2, and the driving sound source signal generating unit 14 fetches the pitch of a voice from the control data storage unit 2. In step S110, the beat synchronization point interval setting unit 11 sets the beat synchronization point interval by using the phoneme time length coefficient of the parameter fetched into the parameter storage unit 10 and the speech production speed fetched from the control data storage unit 2. Assuming the speech production speed of the control data is m (mora/sec), the standard beat synchronization point interval is Ts=100 N/m (the number of samples/mora). N (120 points for 12-kHz sampling) is the standard time length of one frame. The beat synchronization point interval is equal to the standard beat synchronization point interval times the phoneme time length coefficient a, $$T'=\alpha\times Ts$$

Figure 9:
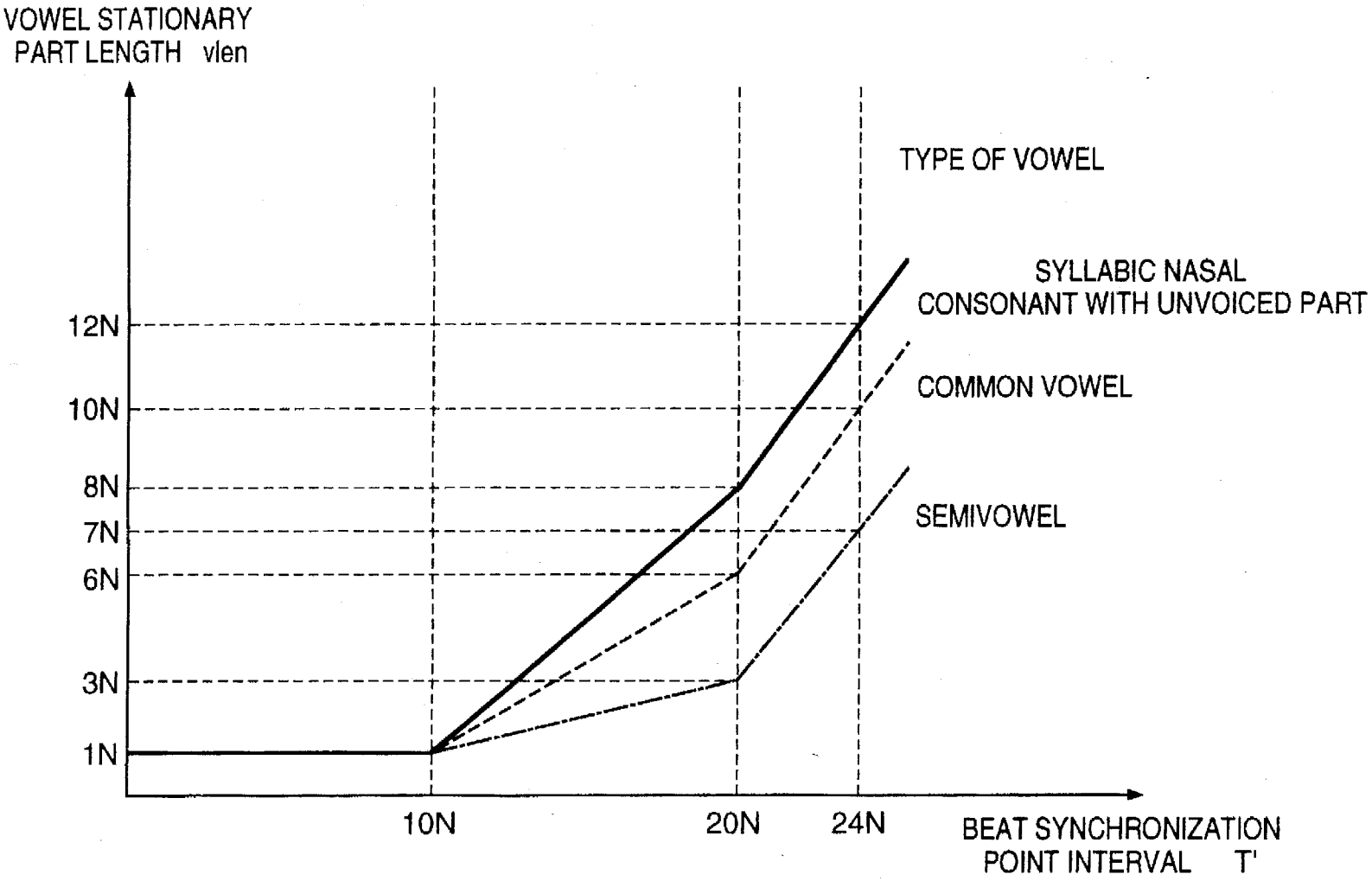
FIG. 9 is a view showing one practical example of the setting of a vowel stationary part length in the first embodiment.

In step S111, the vowel stationary part length setting unit 12 sets the vowel stationary part length by using the vowel type of the parameter fetched into the parameter storage unit 10 and the beat synchronization point interval set by the beat synchronization point interval setting unit 11. As an example, the vowel stationary part length, vlen, is determined from the type of vowel voweltype and the beat synchronization point interval T; as shown in FIG. 9.

In step S112, the frame time length setting unit 13 sets the frame time length by using the beat synchronization point interval set by the beat synchronization point interval setting unit 11 and the vowel stationary part length set by the vowel stationary part length setting unit 12. Assume that the difference, δ, between the time length after expansion or compression and the time length before expansion or compression is $$\delta=T'-vlen-plen$$

when the vowel stationary part flag vowelflag is OFF (a non-vowel stationary part), and the difference δ is $$\delta=vlen-plen$$

when the vowel stationary part flag vowelflag is ON (a vowel stationary part). A time length (sample number) $n_k$ of the kth frame is calculated using Equation (3) presented earlier.

Figure 10:
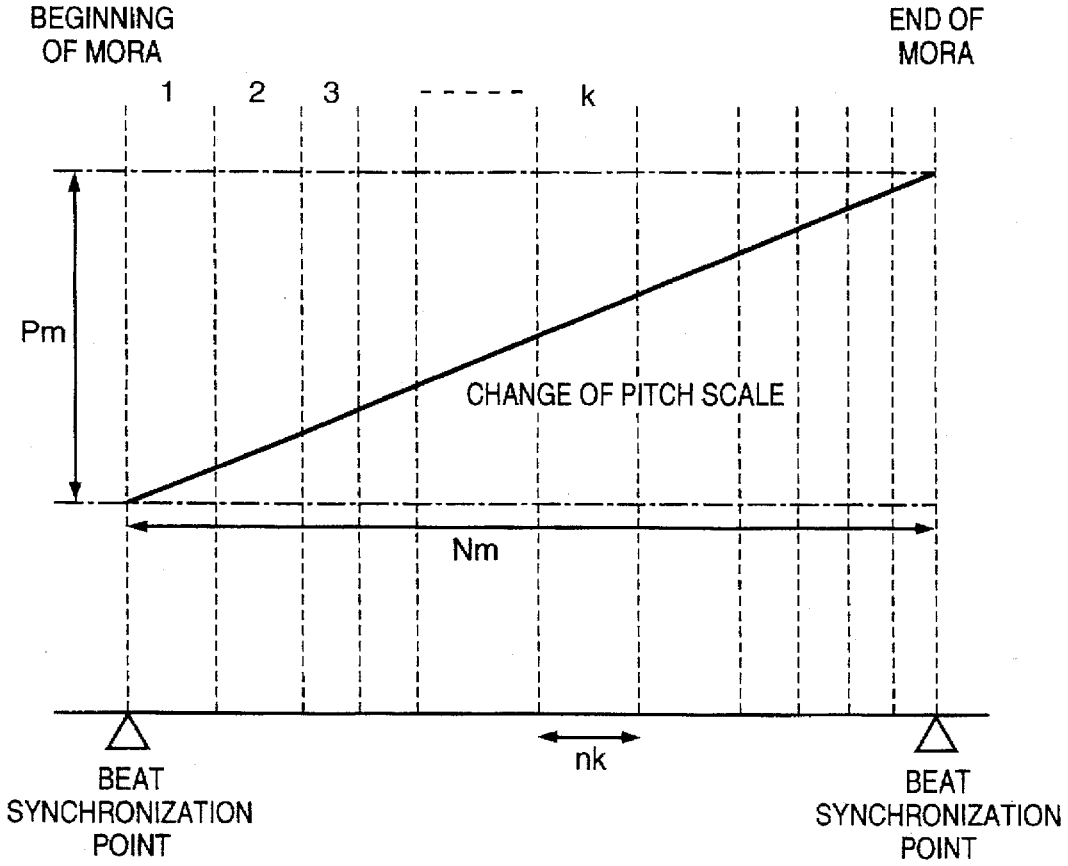
FIG. 10 is a view showing the concept of the generation of a pitch scale in the first embodiment.

In step S113, the driving sound source signal generating unit 14 generates a pitch scale by using the voice pitch fetched from the control data storage unit 2, the accent information of the parameter fetched into the parameter storage unit 10, and the frame time length set by the frame time length setting unit 13, thereby generating a driving sound source signal. FIG. 10 shows the concept of the generation of the pitch scale. The level of accent, $P_m$, which changes during one mora and the number of samples, $N_m$, in one mora are calculated by $$P_m=\text{accLevel}/\text{accMora}$$

$$N_m=T'$$

The pitch scale is so generated that it linearly changes during one mora if the speech production speed remains unchanged. Assuming that the time length of the kth frame is $n_k$ samples, the value of $n_k$ changes in accordance with k. However, the pitch scale is so set as to change in units of $P_m/N_m$ per sample regardless of the change of $n_k$.

Figure 11:
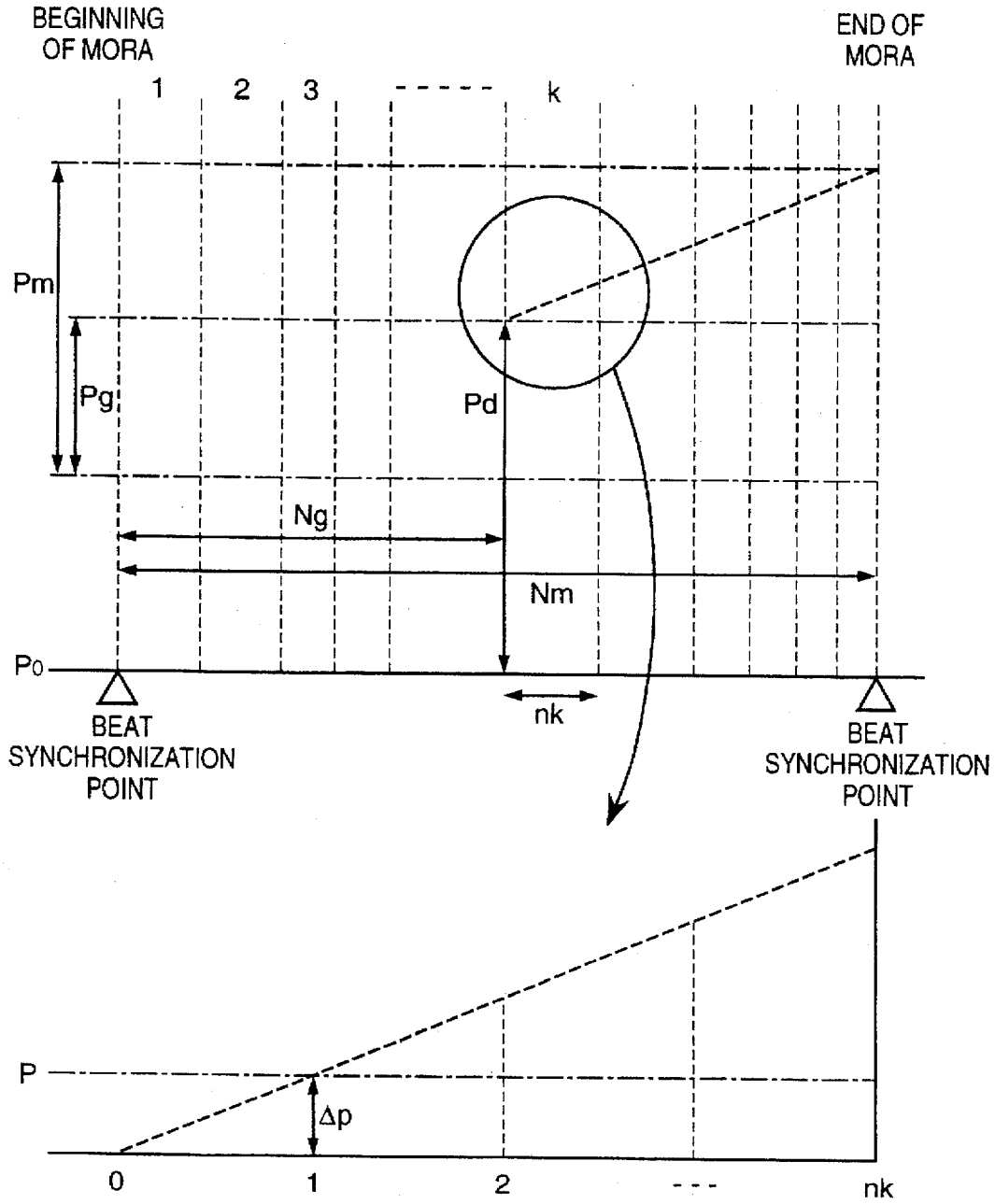
FIG. 11 is a view for explaining the pitch scale generation method in the first embodiment.

Processing based on the above rule will be described below, in which the pitch scale can be changed in units of frames even if the speech production speed changes during the course of the processing. FIG. 11 is a view for explaining generation of the pitch scale. Assuming the level of accent which changes during the time from the beat synchronization point to the kth frame is $P_g$ and the number of samples processed is $N_g$, the pitch scale need only change by $(P_m-P_g)$ for the remaining samples $(N_m-N_g)$. Therefore, the pitch scale change amount per sample is obtained by $$\Delta p=(P_m-P_g)/(N_m-N_g)$$

Suppose that the initial value of the pitch scale is $P_O$ and the difference between the pitch scales P and $P_O$ is $P_d$, the initial value of the pitch scale of the kth frame is $$P=P_O+P_d$$

Subsequently, processing represented by $$P=P+\Delta_p \qquad (4)$$

$$P_g=P_g+\Delta p.$$

in which the pitch scale is updated for each sample is executed for the time length $n_k$ of the kth frame. Finally, $N_g$ and $P_d$ are updated as follows:

$$N_g=N_g+n_k$$

$$P_d=P-P_O.$$

If the voiced]unvoiced information of the parameter indicates voiced speech, a driving sound source signal corresponding to the pitch scale calculated by the above method is generated. On the other hand, if the voiced-unvoiced information of the parameter indicates unvoiced speech, a driving sound source signal corresponding to the unvoiced sound is generated.

Figure 12:
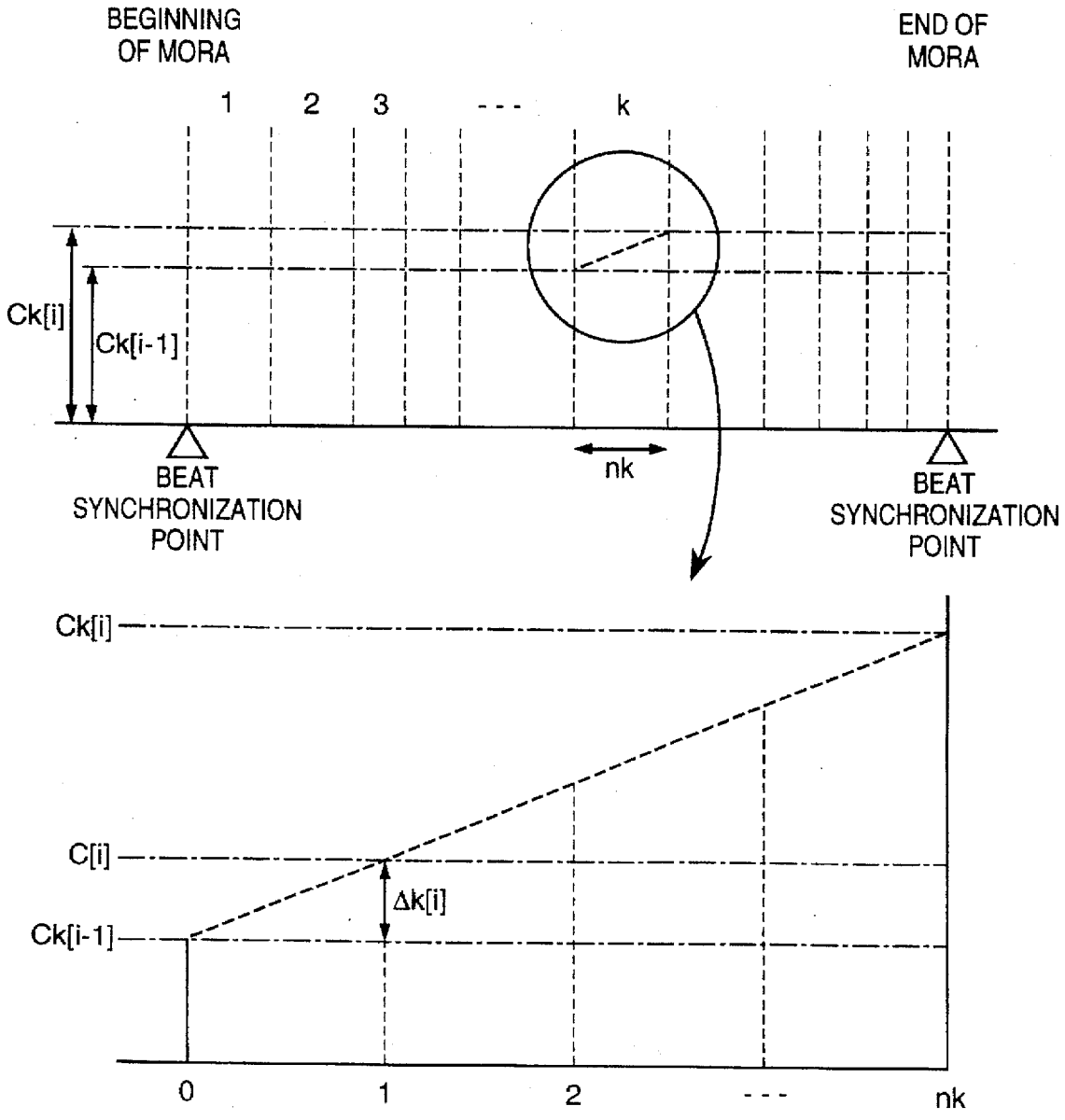
FIG. 12 is a view for explaining the interpolation of a synthetic parameter in the first embodiment.

In step S114, the synthetic parameter interpolating unit 15 interpolates a synthetic parameter by using a synthetic parameter of elements of the parameter fetched into the parameter storage unit 10 and the frame time length set by the frame time length setting unit 13. FIG. 12 is a view for explaining the synthetic parameter interpolation. Assume that the synthetic parameter of the kth frame is $c_k[i]$ $(0\leqq i\leqq M)$, the parameter of the (k−1)th frame is $c_{k-1}[i]$ $(0\leqq i\leqq M)$, and the time length of the kth frame is $n_k$ samples. In this case the difference, $\Delta_k[i]$ $(0\leqq i\leqq M)$, of the synthetic parameter per sample is given by $$\Delta_k[i]=(c_k[i]-c_{k-1}[i])/n_k.$$

Subsequently, a synthetic parameter C[i] ($0 \leqq i \leqq M$) is updated for each sample. The initial value of C[i] is $c_{k-1}[i]$, and processing represented by $$C[i]=C[i]+\Delta_k[i] \quad (5)$$

is executed for the time length $n_k$ of the kth frame.

In step S115, the speech synthesizing unit 16 synthesizes speech by using the driving sound source signal generated by the driving sound source signal generating unit 14 and the synthetic parameter interpolated by the synthetic parameter interpolating unit 15. This speech synthesis is done by applying the pitch scale P, calculated by Equations (4) and (5) and the synthetic parameter C[i] ($0 \leqq i \leqq M$), to a synthesis filter for each sample.

In step S116, whether the processing for one frame is completed is checked. If the processing is completed, the flow advances to step S117. If the processing is not completed, the flow returns to step S113 to continue the processing.

In step S117, whether the processing for one mora is completed is checked. If the processing is completed, the flow advances to step S119. If the processing is not completed, externally input control data is stored in the control data storage unit 2 in step S118, and the flow returns to step S108 to continue the processing.

In step S119, whether the processing for the input character string is completed is checked. If the processing is not completed, the flow returns to step S104 to continue the processing.

In the first embodiment described above, the pitch scale linearly changes in units of moras. However, it is also possible to generate the pitch scale in units of labels. In addition, the pitch scale can be generated by using the response of a filter, rather than by linearly changing the pitch scale. In this case data concerning the coefficient or the step width of the filter is used as the accent information.

Also, FIG. 9, used in the setting of the vowel stationary part length, is merely an example, so another setting can also be performed.

According to the first embodiment as described above, the number of frames can be maintained constant with respect to a change in the production speed of synthetic speech. This makes it feasible to prevent degradation in the tone quality at high speeds and suppress a drop in the processing speed and an increase in the required capacity of a memory at low speeds. It is also possible to change the speech production speed in units of frames.

Second Embodiment

In the first embodiment, the accent information setting unit 6 controls the accent in producing speech. In this second embodiment, speech is produced by using a pitch scale for controlling the pitch of a voice. In the second embodiment, portions different from those of the first embodiment will be described, and a description of portions similar to those of the first embodiment will be omitted.

Figure 13:
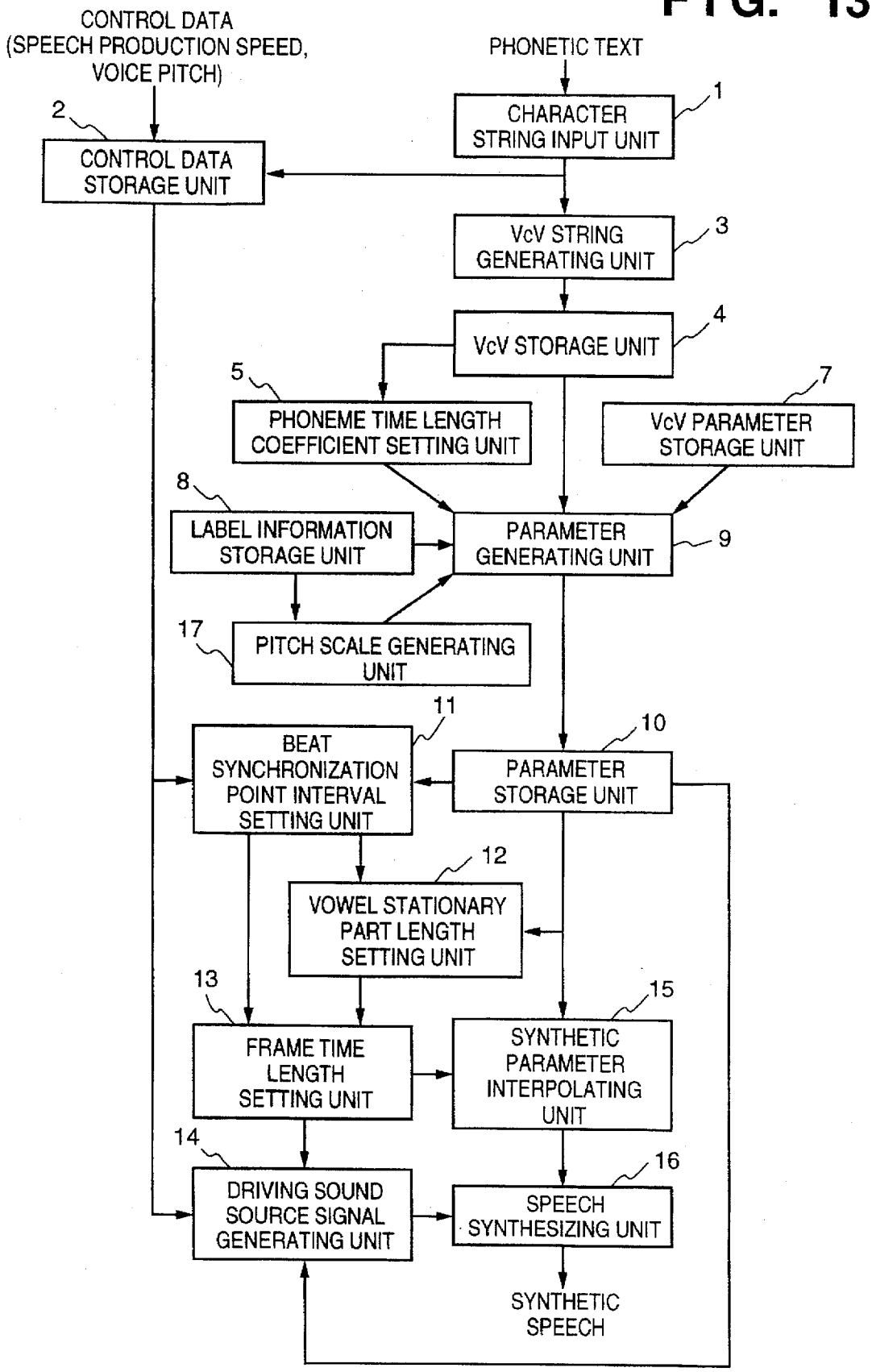
FIG. 13 is a block diagram showing the configuration of functional blocks of a speech synthesizer according to a second embodiment.

FIG. 13 is a block diagram showing the arrangement of functional blocks of a speech synthesizer according to the second embodiment. Parts denoted by reference numerals 4, 5, 7, 8, 9, and 17 in this block diagram will be described below.

A VcV storage unit 4 stores VcV generated by a VcV string generating unit 3 into internal registers. A phoneme time length coefficient setting unit 5 stores a value which represents the degree to which the beat synchronization point interval of synthetic speech is to be expanded from a standard beat synchronization point interval in accordance with the type of VcV stored in the VcV storage unit 4. A VcV parameter storage unit 7 stores VcV parameters corresponding to the VcV string generated by the VcV string generating unit 3, or stores a V (vowel) parameter or a cV parameter which is the data at the beginning of a word. A label information storage unit 8 stores labels for distinguishing the acoustic boundaries between a vowel start point, a voiced section, and an unvoiced section, and labels indicating beat synchronization points, for each VcV parameter stored in the VcV parameter storage unit 7, together with the position information of these labels. A parameter generating unit 9 generates a parameter string corresponding to the VcV string generated by the VcV string generating unit 3. The procedure of the parameter generating unit 9 will be described later. A pitch scale generating unit 17 generates a pitch scale for the parameter string generated by the parameter generating unit 9.

Figure 14:
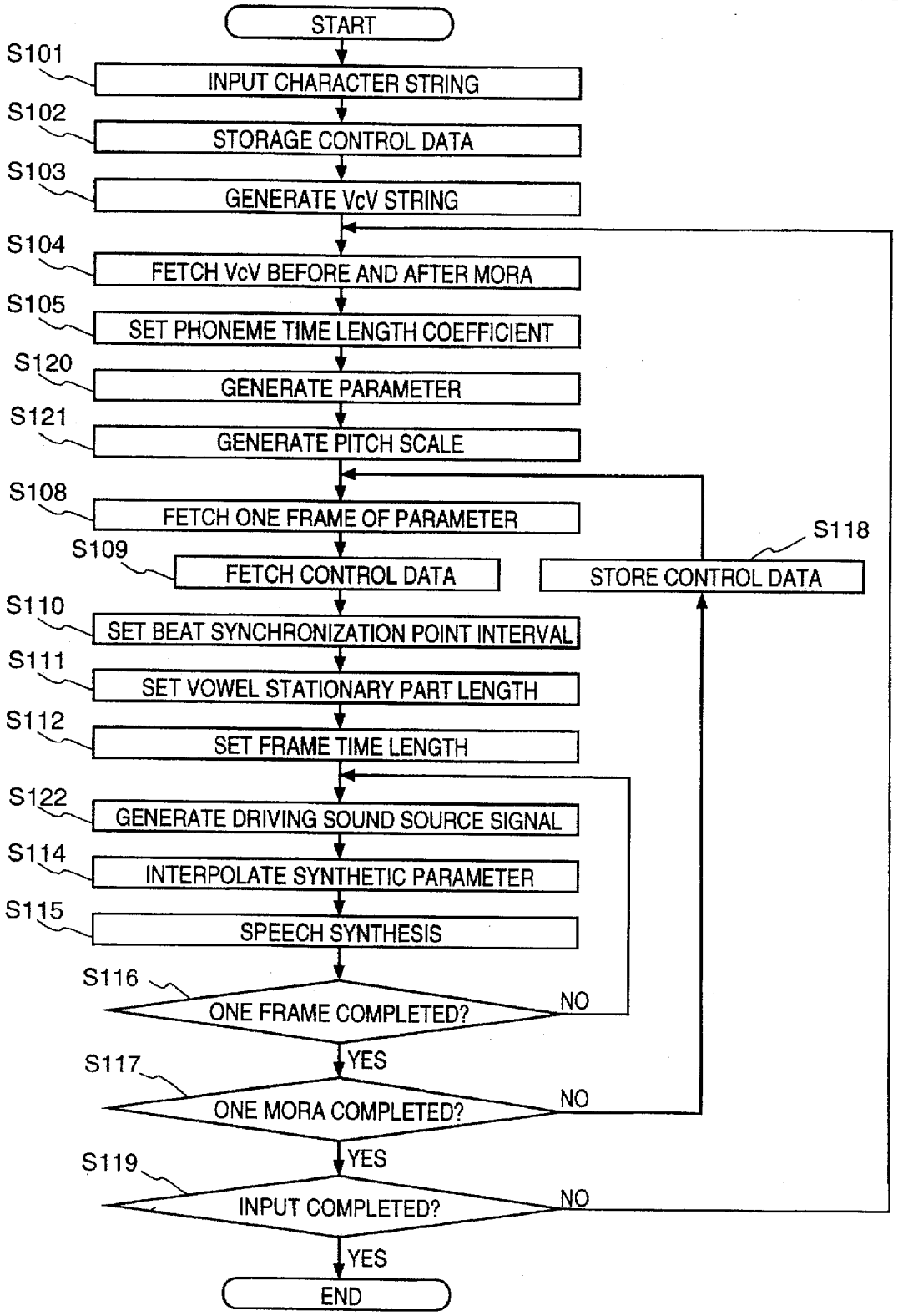
FIG. 14 is a flow chart showing the speech synthesis procedure in the second embodiment.

Generation of a parameter, generation of a pitch scale, and generation of a driving sound source signal, different from those of the processing in the flow chart of FIG. 5, will be described below with reference to FIG. 14. Other steps are denoted by the same step numbers as in the first embodiment.

In step S120, the parameter generating unit 9 generates a parameter string of one mora by using the phoneme time length coefficient set by the phoneme time length coefficient setting unit 5, the VcV parameter fetched from the VcV parameter storage unit 7, and the label information fetched from the label information storage unit 8.

In step S121, the pitch scale generating unit 17 generates a pitch scale for the parameter string generated by the parameter generating unit 9, by using the label information fetched from the label information storage unit 8. The pitch scale thus generated gives the difference from a pitch scale V, which corresponds to a reference value of the pitch of a voice. The generated pitch scale is stored in a pitch scale pitch in FIG. 15.

In step S122, a driving sound source signal generating unit 14 generates a driving sound source signal by using the voice pitch fetched from a control data storage unit 2, the pitch scale of the parameter fetched into a parameter storage unit 10, and the frame time length set by a frame time length setting unit 13.

Figure 16:
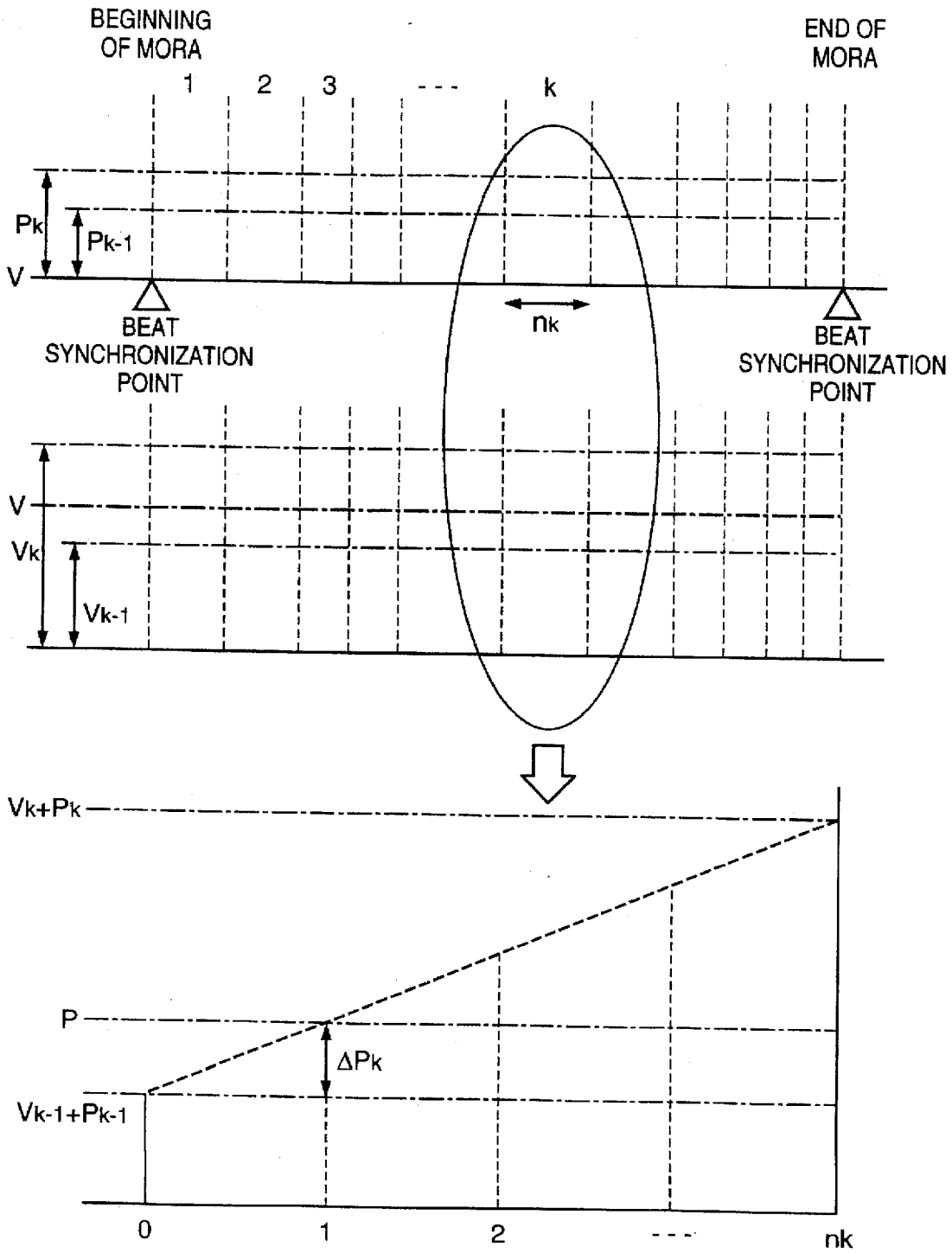
FIG. 16 is a view for explaining the interpolation of a pitch scale in the second embodiment.

FIG. 16 is a view for explaining the interpolation of the pitch scale. Suppose the pitch scale from the beat synchronization point to the (k−1)th frame is $P_{k-1}$ and the pitch scale from the beat synchronization point to the kth frame is $P_k$. Each of $P_{k-1}$ and $P_k$ gives the difference from the pitch scale V corresponding to the reference value of the voice pitch. Suppose also that the pitch scale corresponding to the voice pitch from the beat synchronization point to the (k−1)th frame is $V_{k-1}$ and the pitch scale corresponding to the voice pitch from the beat synchronization point to the kth frame is $V_k$. That is, consider the case in which the voice pitch stored in the control data storage unit 2 changes from $V_{k-1}$ to $V_k$. In this case the change amount, $\Delta P_k$, of the pitch scale per sample is given by $$\Delta P_k=((V_k+P_k)-(V_{k-1}+P_{k-1}))/n_k.$$

Subsequently, the pitch scale P is updated for each sample. The initial value of P is $V_{k-1}+P_{k-1}$, and processing represented by $$P=P+\Delta P_k,$$

is executed for the time length, $n_k$, of the kth frame.

If the voiced·unvoiced information of the parameter indicates voiced speech, a driving sound source signal corresponding to the pitch scale interpolated by the above method is generated. On the other hand, if the voiced·unvoiced information of the parameter indicates unvoiced speech, a driving sound source signal corresponding to the unvoiced speech is generated.

Third Embodiment

The third embodiment of the present invention will be described below.

Figure 17:
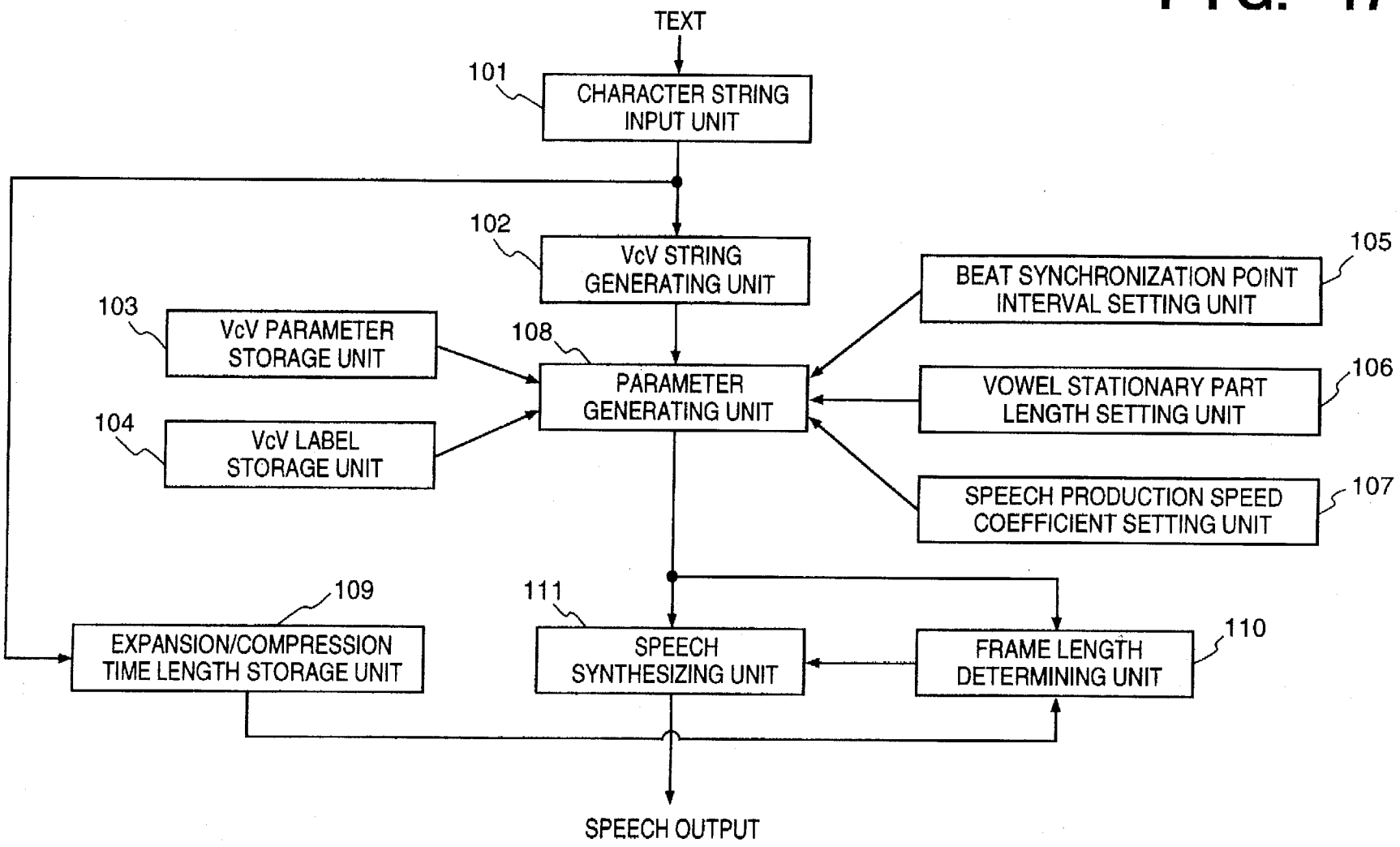
FIG. 17 is a block diagram showing the configuration of functional blocks of a speech synthesizer according to a third embodiment.

FIG. 17 is a block diagram showing the arrangement of functional blocks of a speech synthesizer according to the third embodiment. Referring to FIG. 17, a character string input unit 101 inputs a character string of speech to be synthesized. For example, if the speech to be synthesized is "O·N·SE·I", the character string input unit 101 inputs a character string "OnSEI". A VcV string generating unit 102 converts the input character string from the character string input unit 101 into a VcV string. As an example, the character string "OnSEI" is converted into a VcV string "QO, On, nSE, EI, IQ".

A VcV parameter storage unit 103 stores VcV parameters corresponding to the VcV string generated by the VcV string generating unit 102, or a V (vowel) parameter, or a cV parameter which is the data at the beginning of a word. A VcV label storage unit 104 stores labels for distinguishing the acoustic boundaries between a vowel start point, a voiced section, and an unvoiced section, and labels indicating beat synchronization points, for each VcV parameter stored in the VcV parameter storage unit 103, together with the position information of these labels.

A beat synchronization point interval setting unit 105 sets the standard beat synchronization point interval of synthetic speech. A vowel stationary part length setting unit 106 sets the time length of a vowel stationary part pertaining to the connection of VcV parameters in accordance with the standard beat synchronization point interval set by the beat synchronization point interval setting unit 105 and with the type of vowel. A speech production speed coefficient setting unit 107 sets the speech production speed coefficient of each frame by using an expansion degree which is determined in accordance with the type of label stored in the VcV label storage unit 104. For example, a vowel part or a fricative sound, whose length readily changes with the speech production speed, is given a speech production speed coefficient with a large value, and a plosive, which hardly changes its length, is given a speech production speed coefficient with a small value.

A parameter generating unit 108 generates a VcV parameter string matching the standard beat synchronization point interval, which corresponds to the VcV string generated by the VcV string generating unit 102. In this embodiment, the parameter generating unit 108 connects the VcV parameters read out from the VcV parameter storage unit 103 on the basis of the information of the vowel stationary part length setting unit 106 and the beat synchronization point interval setting unit 105. The procedure of the parameter generating unit 108 will be described later.

An expansion/compression time length storage unit 109 extracts a sequence code pertaining to expansion/compression time length control from the input character string from the character string input unit 101, interprets the extracted sequence code, and stores a value which represents the degree to which the beat synchronization point interval of synthetic speech is to be expanded from the standard beat synchronization point interval.

A frame length determining unit 110 calculates the length of each frame from the speech production speed coefficient of the parameter obtained from the parameter generating unit 108 and the expansion/compression time length stored in the expansion/compression time length storage unit 109. A speech synthesizing unit 111 outputs synthetic speech by sequentially generating speech waveforms on the basis of the VcV parameters obtained from the parameter generating unit 108 and the frame length obtained from the frame length determining unit 110.

The operation procedure of the speech synthesizer with the above arrangement will be described below with reference to FIGS. 18 and 19.

Figure 18:
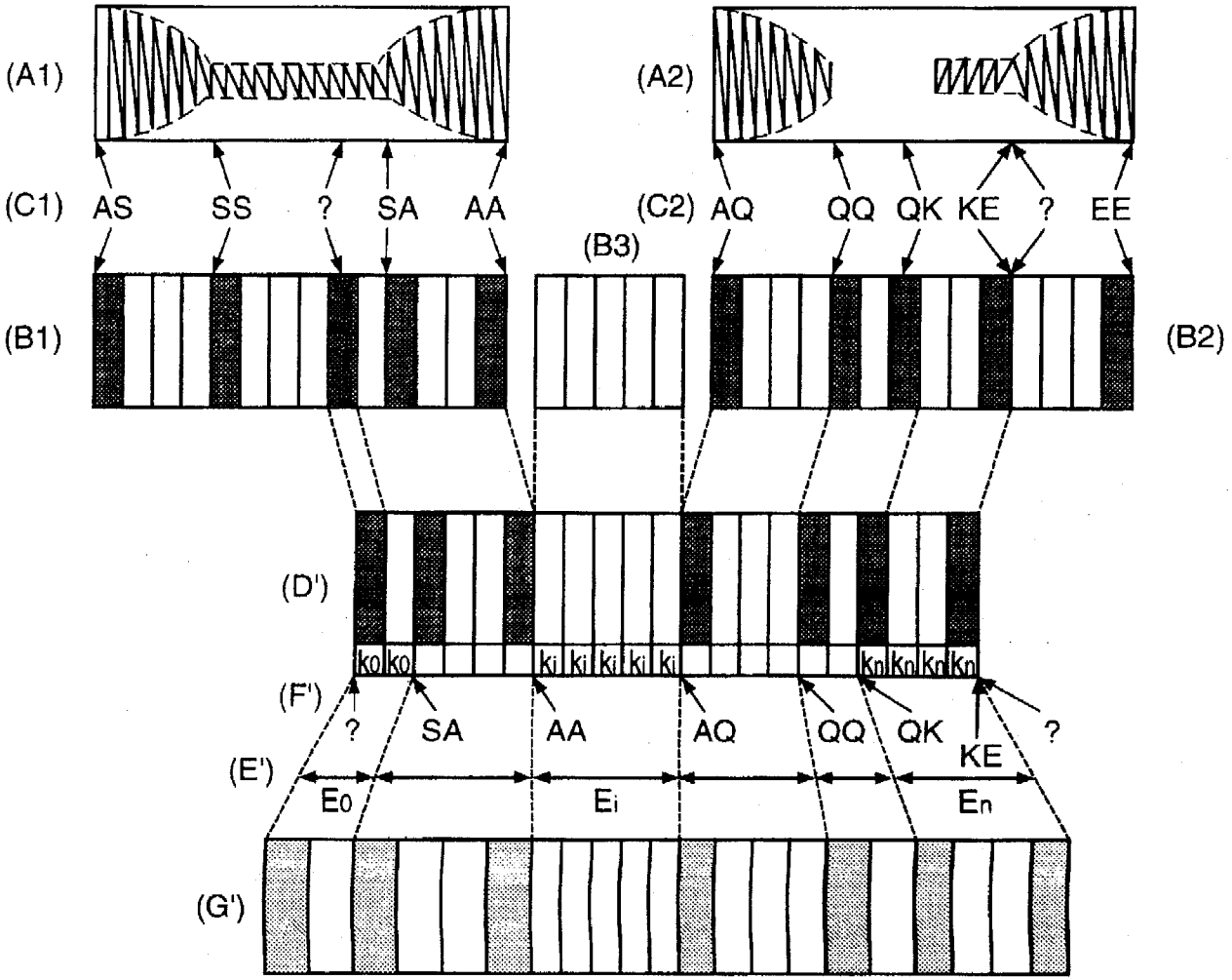
FIG. 18 is a view for explaining the procedure of speech synthesis using VcV parameters in the third embodiment.
Figure 19:
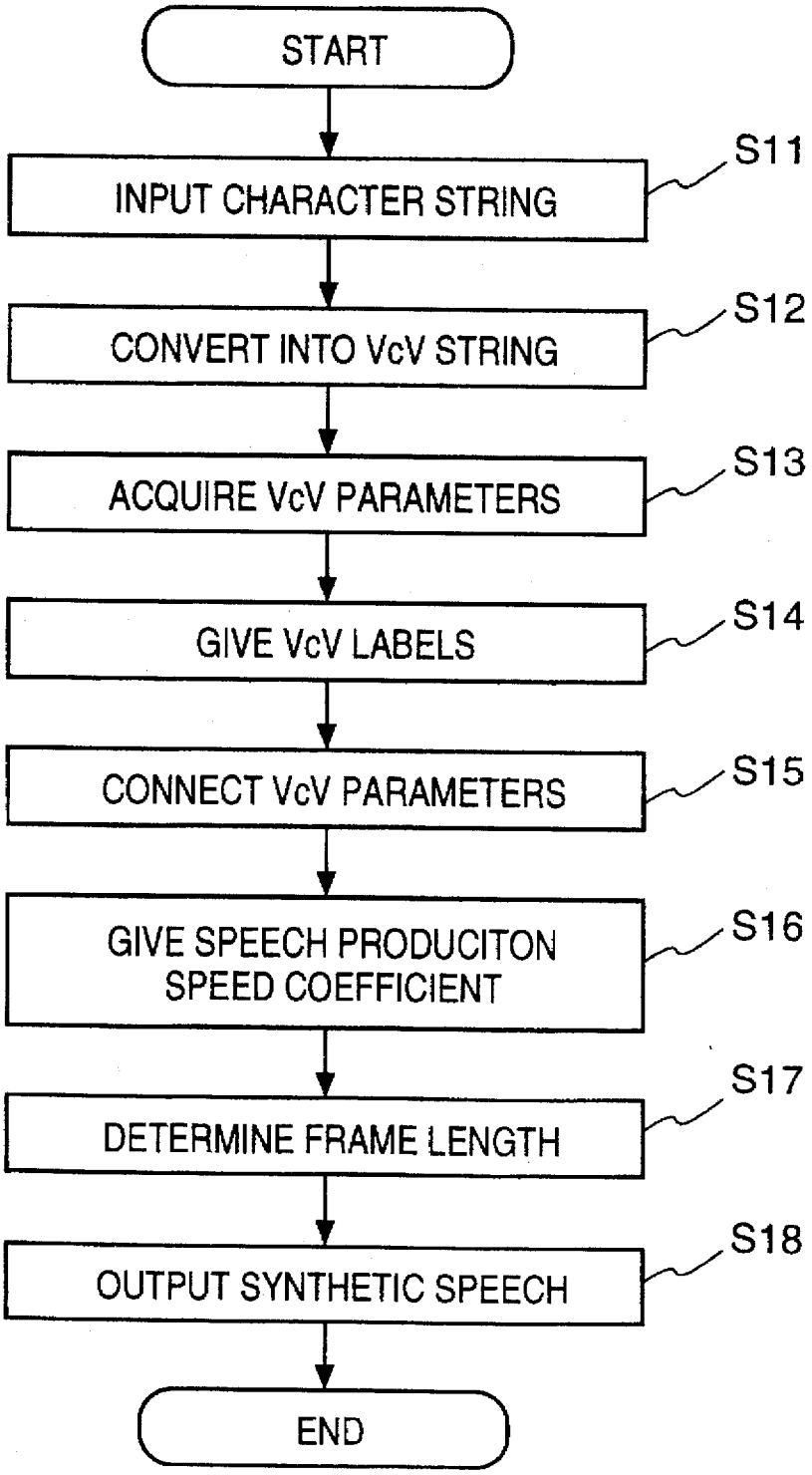
FIG. 19 is a flow chart showing the operation procedure of the speech synthesizer in the third embodiment.

FIG. 18 illustrates one example of speech synthesis using VcV parameters as phonemes. Note that the same reference numerals as in FIG. 1 denote the same parts in FIG. 18, and a detailed description thereof will be omitted.

Referring to FIG. 18, VcV parameters (B1) and (B2) are stored in the VcV parameter storage unit 103. A parameter (B3) is the parameter to be interpolated in accordance with the standard beat synchronization point interval and the type of vowel relating to the connection. This parameter is generated by the parameter generating unit 108 on the basis of the information stored in the beat synchronization point interval setting unit 105 and the vowel stationary part length setting unit 106. Label information, (C1) and (C2), of the individual parameters are stored in the VcV label storage unit 104.

(D') is a frame string formed by extracting parameters (frames) corresponding to a portion from the position of the beat synchronization point in (C1) to the position of the beat synchronization point in (C2) from (B1), (B3), and (B2), and connecting these parameters. Each frame in (D') is further added to an area for storing a speech production speed coefficient $K_i$. (E') indicates expansion degrees set in accordance with the types of adjacent labels. (F') is label information corresponding to (D'). (G') is the result of expansion or compression performed by the speech synthesizing unit 111 for each frame in (D'). The speech synthesizing unit 111 generates a speech waveform in accordance with the parameter and the frame lengths in (G').

The above operation will be described in detail below with reference to FIG. 19.

In step S11, the character string input unit 101 inputs a character string of speech to be synthesized. In step S12, the VcV string generating unit 102 converts the input character string into a VcV string. In step S13, VcV parameters (FIG. 18, (B1) and (B2)) of the VcV string to be subjected to speech synthesis are acquired from the VcV parameter storage unit 103. In step S14, labels (FIG. 18, (C1) and (C2)) representing the acoustic boundaries and the beat synchronization points are extracted from the VcV label storage unit 104 and given to the VcV parameters. In step S15, a parameter (FIG. 18, (B3)) for connecting the VcV parameters is generated in accordance with the information from the beat synchronization point interval setting unit 105 and the vowel stationary part length setting unit 106, and the VcV parameters are connected by using this parameter. Subsequently, the speech production speed coefficient setting unit 107 gives a speech production speed coefficient for each frame.

The method of giving the speech production speed will be described in more detail below with reference to (D'), (E'), and (F') in FIG. 18.

Assume that the expansion degree between the labels (FIG. 18, (F')) is $E_i$ ($0 \leqq i \leqq n$), the time interval between the labels before expansion or compression (i.e., the time interval between the labels at the standard synchronization point interval) is $S_i$ ($0 \leqq i \leqq n$), and the time interval between the labels after expansion or compression is $D_i$ ($0 \leqq i \leqq n$).

In this case, the expansion degree $E_i$ is defined such that the following equation is established (FIG. 18, (E')).

$$D_0-S_0:\cdots:D_i-S_i:\cdots:D_n-S_n=E_0S_0:\cdots:E_iS_i:\cdots:E_nS_n.$$

This expansion degree $E_i$ is stored in the speech production speed coefficient setting unit 107. The speech production speed coefficient $K_i$ is calculated by using the expansion degree $E_i$ as follows:

$$K_i=E_i/(E_0S_0+\cdots+E_iS_i+\cdots+E_nS_n).$$

The speech production speed coefficient setting unit 107 gives this speech production speed coefficient $K_i$ to each frame (FIG. 18, (D')).

When the speech production speed coefficient of each frame is set in step S16 as described above, the flow advances to step S17 in which the frame length determining unit 110 determines the frame length (the time interval) of each frame. Assuming the time length of each frame before expansion or compression is $T_0$ and the total increased time length after expansion or compression stored in the expansion/compression time length storage unit 109 is $T_p$, the time length, $T_i$, of each frame after expansion or compression is calculated by the following equation:

$$T_i=(K_iT_p+1)T_0.$$

In step S18, the frame length determining unit 110 calculates the frame length of each frame, and the speech synthesizing unit 111 performs interpolation in these frames such that the frames have their respective calculated frame lengths, thereby synthesizing speech.

According to this embodiment as described above, the number of frames can be held constant with respect to a change in the speech production speed. The result is that the tone quality does not degrade even when the speech production speed is increased and the required memory capacity does not increase even when the speech production speed is lowered. In addition, since the speech synthesizing unit 111 calculates the frame length for each frame, it is possible to respond to a change in the speech production speed in real time. Furthermore, the pitch scale and the synthetic parameter of each frame are also properly changed in accordance with a change in the speech production speed. This makes it possible to maintain natural synthetic speech.

Note that in the above third embodiment the frame lengths are equal before expansion or compression. However, the present invention can be applied to the case in which the frame lengths of the parameter (D'), FIG. 18, are different. In this case, each frame is given a time interval $T_{i0}$ at the standard beat synchronization point interval, and the frame length determining unit 110 calculates the frame length of each frame by using the following equation:

$$T_i=(K_iT_p+1)T_{i0}.$$

The speech synthesizing unit 111 performs interpolation in these frames such that the frames have their respective calculated frame lengths, thereby producing synthetic speech. In this manner, expansion is readily possible even if the frame length at the standard beat synchronization point interval is variable.

The use of the variable frame length as described above allows preparation of parameters of, e.g., a plosive with fine steps. This contributes to an improvement in the clearness of synthetic speech.

Fourth Embodiment

The fourth embodiment relates to a speech synthesizer capable of changing the production speed of synthetic speech by using a D/A converter which operates at a frequency which is a multiple of the sampling frequency.

Figure 20:
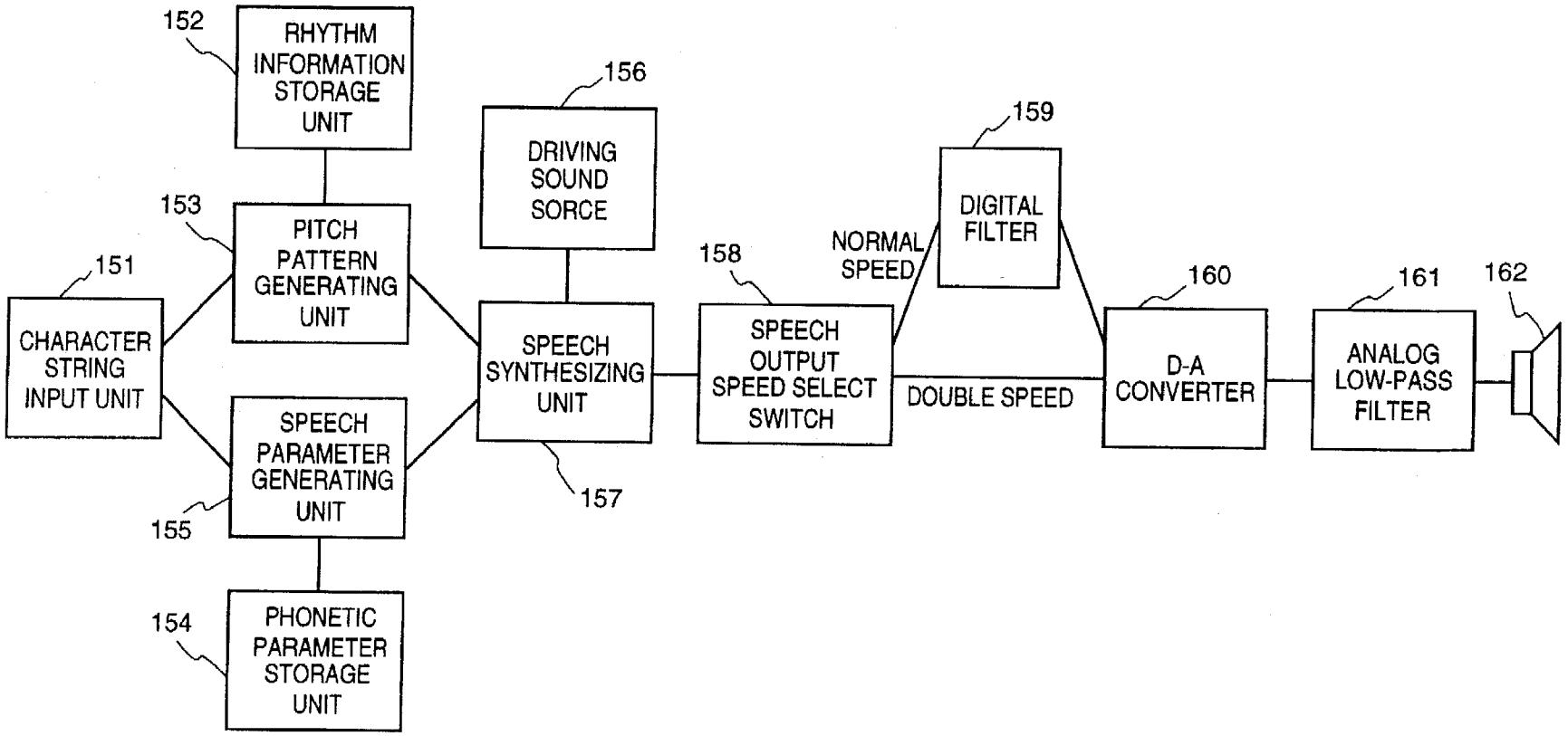
FIG. 20 is a block diagram showing the configuration of functional blocks of a rule-based speech synthesizer according to a fourth embodiment.

FIG. 20 is a block diagram showing the arrangement of functional blocks of a rule speech synthesizer according to the fourth embodiment. In this embodiment synthetic speech is output at two different speeds, a normal speed and a speed which is twice the normal speed. However, the speed multiplier can be some other multiplier.

Referring to FIG. 20, a character string input unit 151 inputs characters representing speech to be synthesized. A rhythm information storage unit 152 stores rhythmical features, such as the tone of sentence speech and the stress and pause of a word. A pitch pattern generating unit 153 generates a pitch pattern by extracting rhythm information corresponding to the input character string from the character string input unit 151. A phonetic parameter storage unit 154 stores spectral parameters (e.g., melcepstrum, PACOR, LPC, or LSP) in units of VcV or cV. A speech parameter generating unit 155 extracts, from the phonetic parameter storage unit 154, the phonetic parameters corresponding to the input character string from the character string input unit 151, and generates speech parameters by connecting the extracted phonetic parameters.

A driving sound source 156 generates a sound source signal, such as an impulse train, for a voiced section, and a sound source signal, such as white noise, for an unvoiced section. A speech synthesizing unit 157 generates a digital speech signal by sequentially coupling, in accordance with a predetermined rule, the pitch pattern obtained by the pitch pattern generating unit 153, the speech parameters obtained by the speech parameter generating unit 155, and the sound source signal obtained by the driving sound source 156.

A speech output speed select switch 158 switches the output speeds of the synthetic speech produced by the speech synthesizing unit 157, i.e., performs switching between a normal output speed and an output speed which is twice as high as the normal output speed. A digital filter 159 doubles the sampling frequency of the digital speech signal generated by the speech synthesizing unit 157. A D-A converter 160 operates at the frequency which is twice the sampling frequency of the digital speech signal generated by the speech synthesizing unit 157.

To output synthetic speech at a normal speed with the above arrangement, the digital filter 159 doubles the sampling frequency of the digital speech signal generated by the speech synthesizing unit 157. The D-A converter 160, having an operating speed which is twice as high as the sampling frequency, converts the resulting digital signal into an analog speech signal at the normal speed. To output synthetic speech at double speed, the digital speech signal generated by the speech synthesizing unit is directly applied to the D-A converter 160 which operates at a frequency twice that of the sampling frequency. Consequently, the D-A converter 160 converts the input digital speech signal into an analog speech signal at the double frequency.

An analog low-pass filter 161 cuts off frequency components, which are higher than the sampling frequency of the digital speech signal generated by the speech synthesizing unit 157, from the analog speech signal generated by the D-A converter 160. A loudspeaker 162 outputs the synthetic speech signal at normal speed or double speed.

The operation of the speech synthesizer of the fourth embodiment with the above arrangement will be described below with reference to FIGS. 21 to 30.

Figure 30:
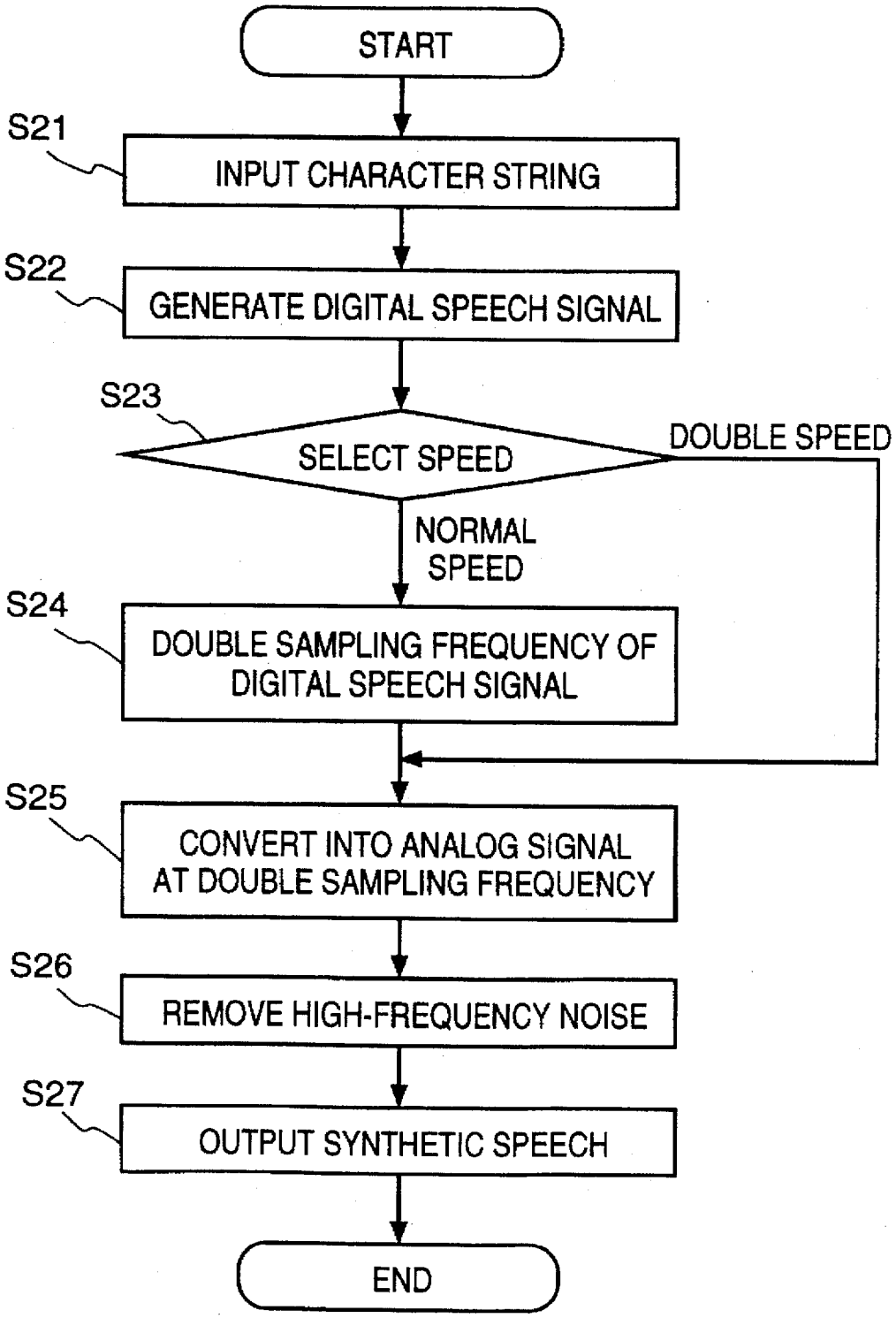
FIG. 30 is a flow chart showing the operation procedure of the speech synthesizer according to the fourth embodiment.

FIG. 30 is a flow chart showing the operation procedure of the speech synthesizer of the fourth embodiment. In step S21, the character string input unit 151 inputs a character string to be subjected to speech synthesis. In step S22, a digital speech signal is generated from the input character string. This process of generating the digital speech signal will be described below with reference to FIG. 21.

Figure 21:
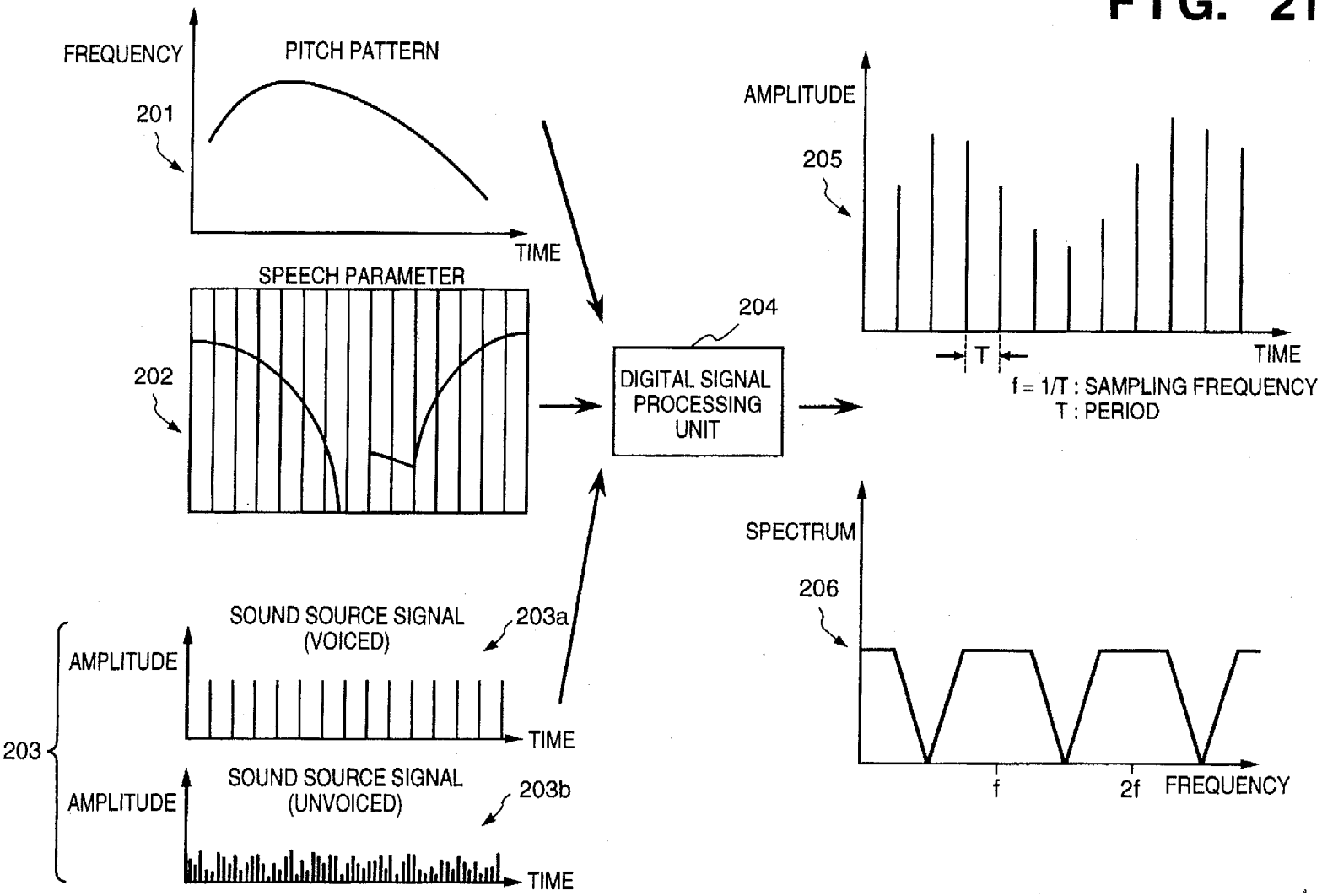
FIG. 21 is a view for explaining the operation of a speech synthesizing unit.

FIG. 21 is a view for explaining the operation of the speech synthesizing unit 157. Reference numeral 201 denotes a pitch pattern generated by the pitch pattern generating unit 153. The pitch pattern 201 represents the relationship between the elapsed time and the frequency with respect to the output speech. A speech parameter 202 is generated by the speech parameter generating unit 155 by sequentially connecting phonetic parameters corresponding to the output speech. Reference numeral 203 denotes a sound source signal generated by the driving sound source 156. The sound source signal 203 is an impulse train (203*a*) for a voiced section and white noise (203*b*) for an unvoiced section. A digital signal processing unit 204 generates, in accordance with, e.g., a PARCOR method, a digital speech signal by coupling the pitch pattern, the speech parameter, and the sound source signal on the basis of a predetermined rule. Reference numeral 205 denotes the output digital speech signal from the digital signal processing unit 204. The digital speech signal 205 is an amplitude information value in units of times T. Assume that the sampling frequency of this signal is f=1/T. A frequency spectrum 206 of the digital speech signal 205 contains unnecessary high-frequency noise components, generated by sampling, with a frequency f/2 or higher.

In step S23, it is checked from the state of the speech output speed select switch 158 whether the output speed is to be normal speed or double speed. If it is determined that the normal speed is to be used, the flow advances to step S24. If it is determined that the double speed is to be used, the flow advances to step S25.

In step S24, the digital filter 159 doubles the sampling frequency of the digital speech signal. This processing performed by the digital filter 159 will be described below with reference to FIGS. 22 and 23.

Figure 22:
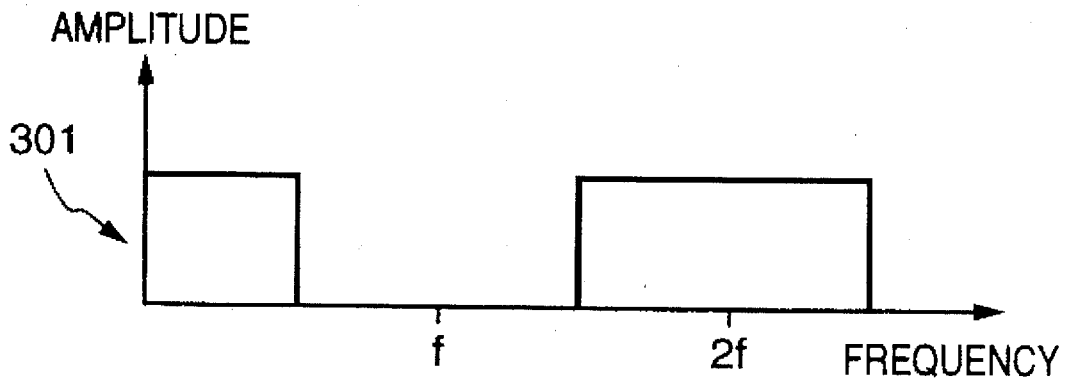
FIG. 22 is a graph showing the frequency characteristic of a digital filter.

Referring to FIG. 22, a frequency spectrum 301 of the digital filter 159 has a steep characteristic having the frequency f/2 as the cutoff frequency.

Figure 23:
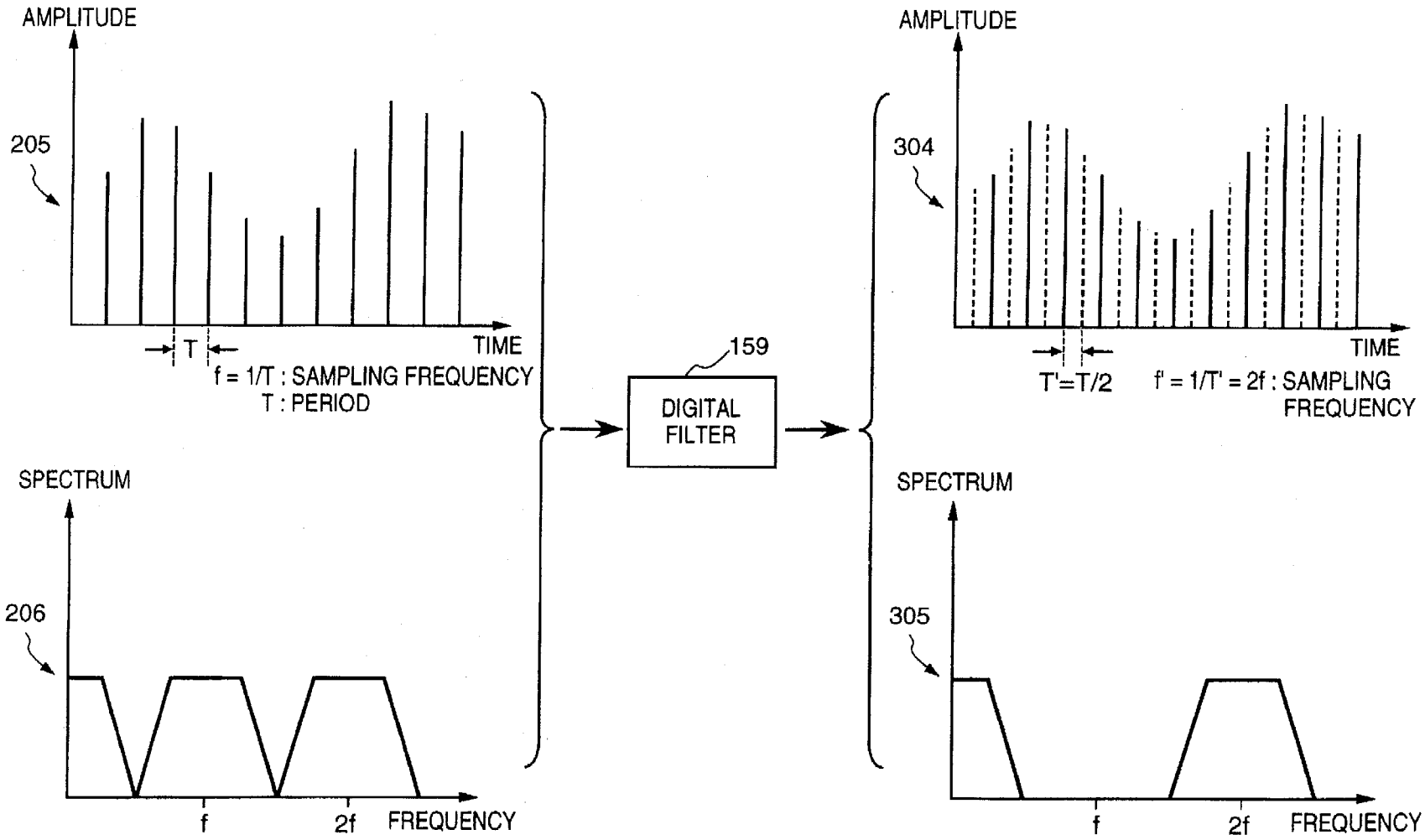
FIG. 23 is a view for explaining the operation of the digital filter.

Referring to FIG. 23, the digital speech signal 205 is generated and output from the speech synthesizing unit 157. Reference numeral 304 denotes the output digital speech signal from the digital filter 159. The frequency of the digital speech signal 304 is doubled by interpolating 0 (zero) into the digital speech signal 205 which is input at a period T. Reference numeral 305 denotes the frequency spectrum of the digital speech signal 304. This frequency spectrum 305 has lost frequency components centered around a frequency (2n+1)f (n=0, 1, 2 . . . ), but still contains unnecessary high-frequency noise components centered around a frequency 2nf (n=1, 2 . . . ).

In step S25, the D-A converter 160 converts the digital speech signal into an analog speech signal. This processing performed by the D-A converter 160 will be described below with reference to FIGS. 24 to 26.

Figure 24:
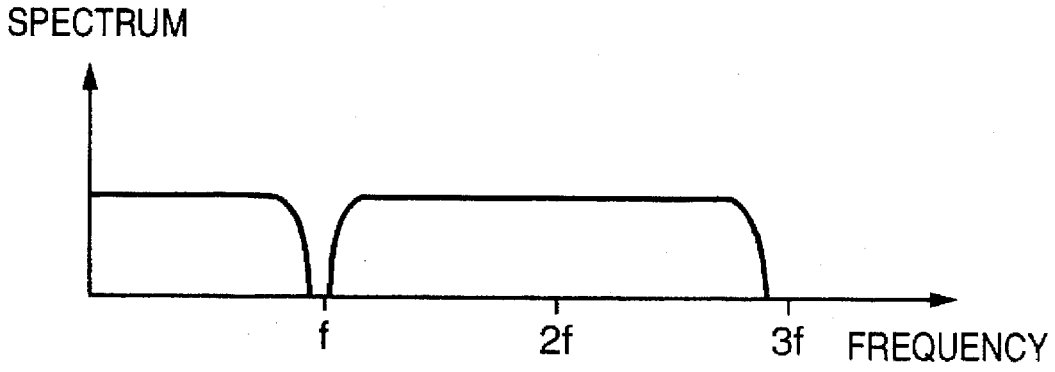
FIG. 24 is a graph showing the frequency characteristic of the output of a D-A converter.

FIG. 24 shows the frequency spectrum of the D-A converter output. This D-A converter operates at the double frequency 2f of the sampling frequency f of the digital speech signal generated by the speech synthesizing unit 157. Therefore, the frequency spectrum shown in FIG. 24 contains high-frequency noise components centered around the frequency 2f.

Figure 25:
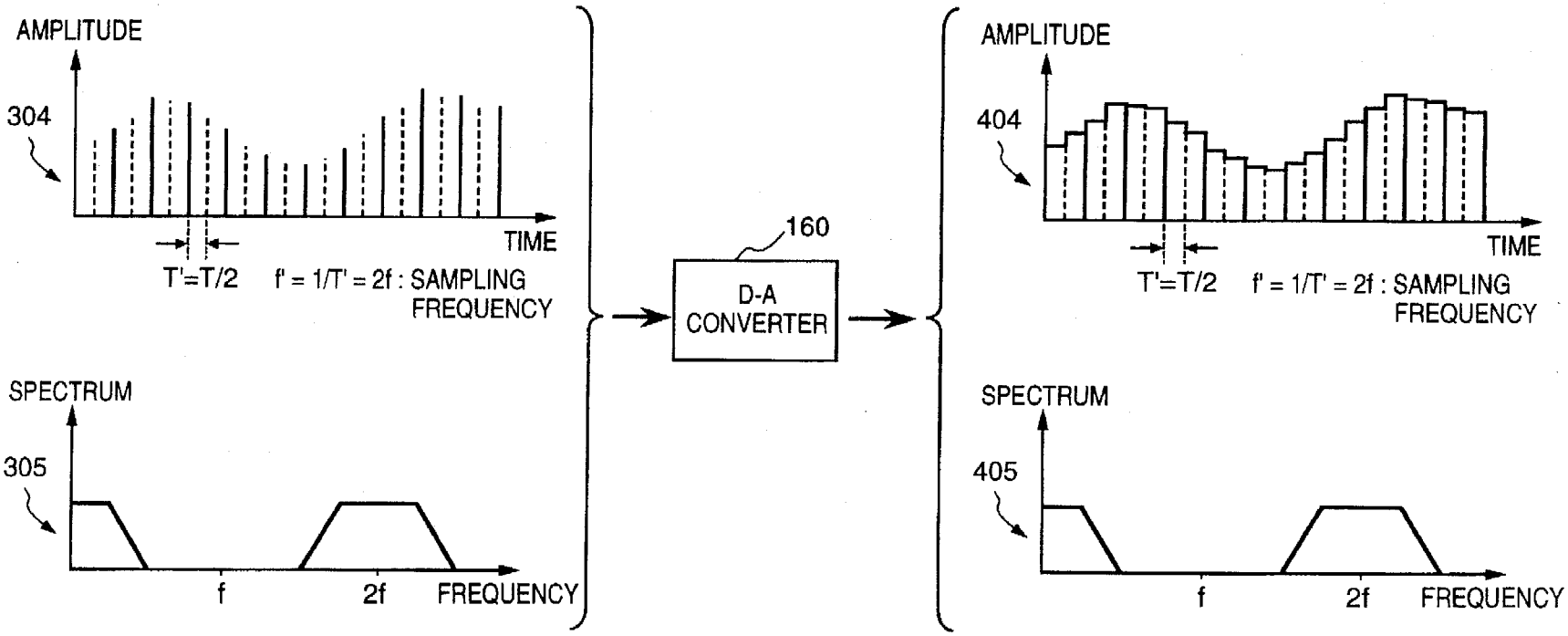
FIG. 25 is a view for explaining the operation of the D-A converter.

In FIG. 25, the digital speech signal 304 obtained through the digital filter 159 has the double sampling frequency and the frequency spectrum 305. An analog speech signal 404 is generated by passing the digital signal 304 through the D-A converter 160 having the frequency spectrum as in FIG. 24. The analog speech signal 404 is output at the normal speed. Reference numeral 405 denotes the frequency spectrum of the analog speech signal 404.

Figure 26:
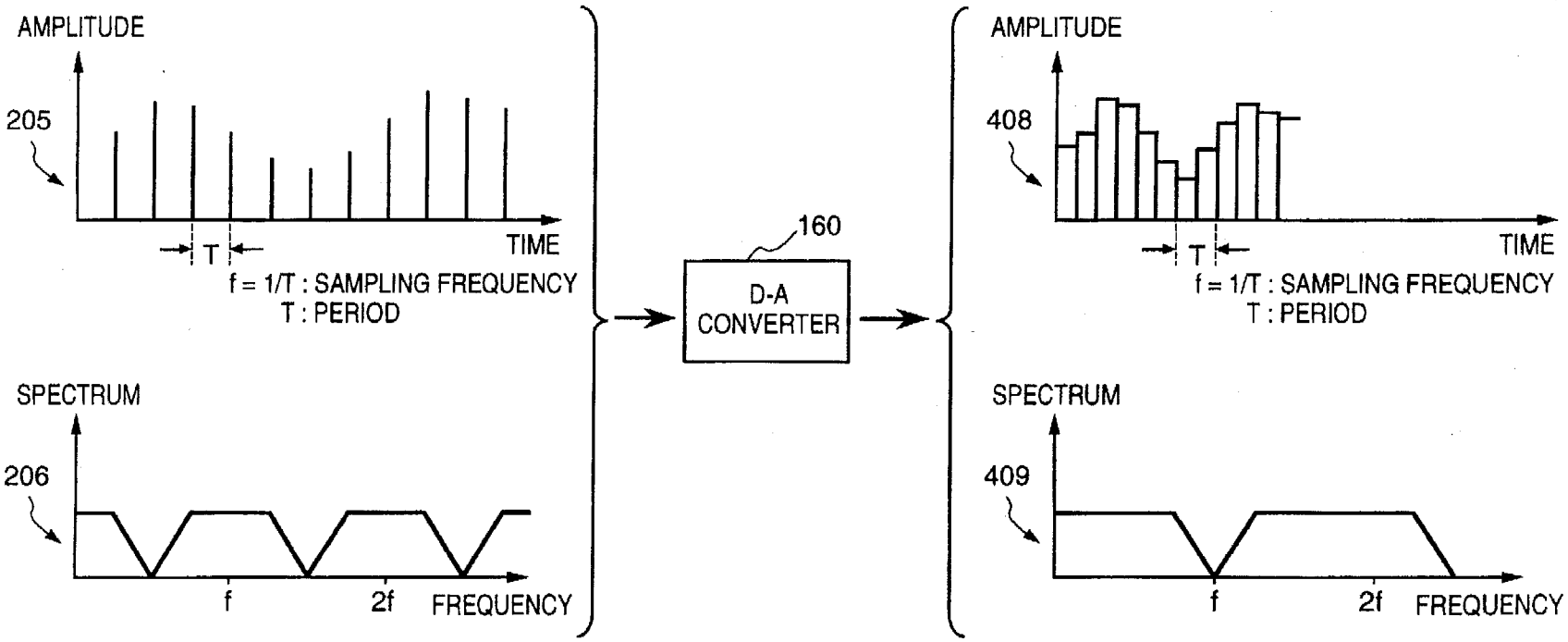
FIG. 26 is a view for explaining the operation of the D-A converter.

Referring to FIG. 26, an analog speech signal 408 is generated by passing the digital speech signal 205, which is generated by the speech synthesizing unit 157 and has the sampling frequency f, through the D-A converter 160 having the frequency spectrum 401. The duration of the analog speech signal 408 is compressed to be half that of the digital speech signal 205. The frequency band of a frequency spectrum 409 of the analog speech signal 408 is doubled from that of the frequency spectrum 206. The frequency spectrum 409 contains unnecessary high-frequency noise components centered around the frequency 2nf (n=1, 2 . . . ) higher than the frequency f.

In step S26, the analog low-pass filter 161 removes high-frequency components from the analog speech signal generated by the D-A converter 160. This operation of the analog low-pass filter 161 will be described below with reference to FIGS. 27 to 29.

Figure 27:
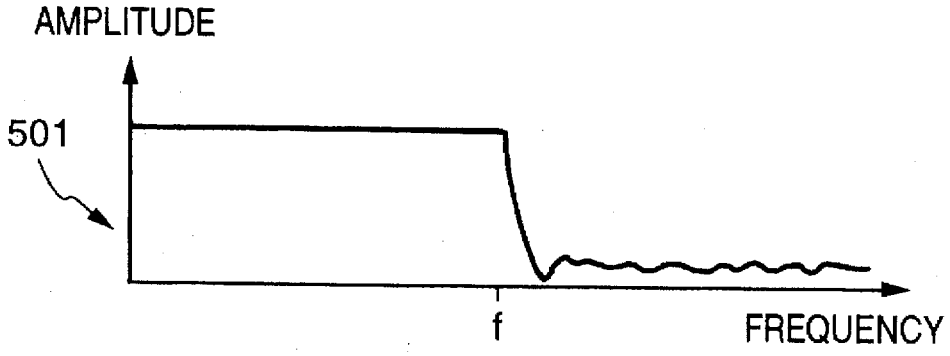
FIG. 27 is a graph showing the frequency characteristic of an analog low-pass filter.
Figure 28:
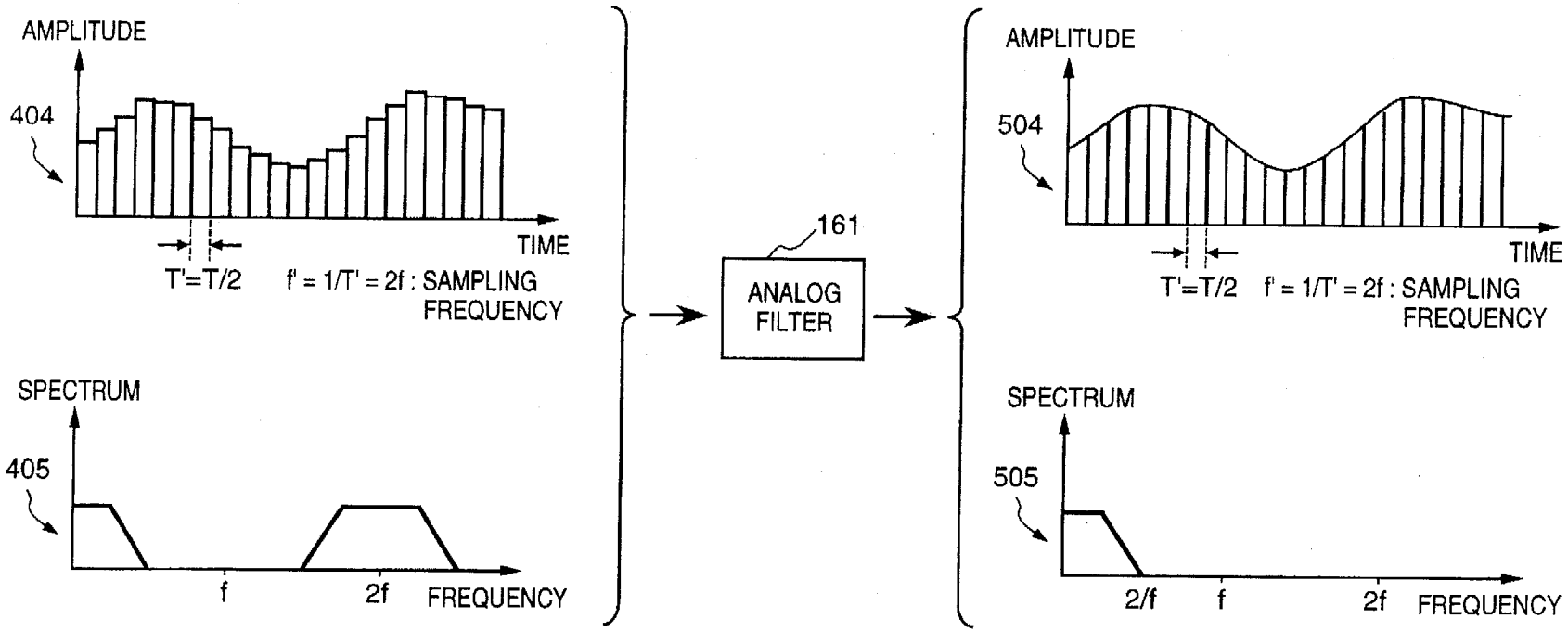
FIG. 28 is a view for explaining the operation of the analog low-pass filter.
Figure 29:
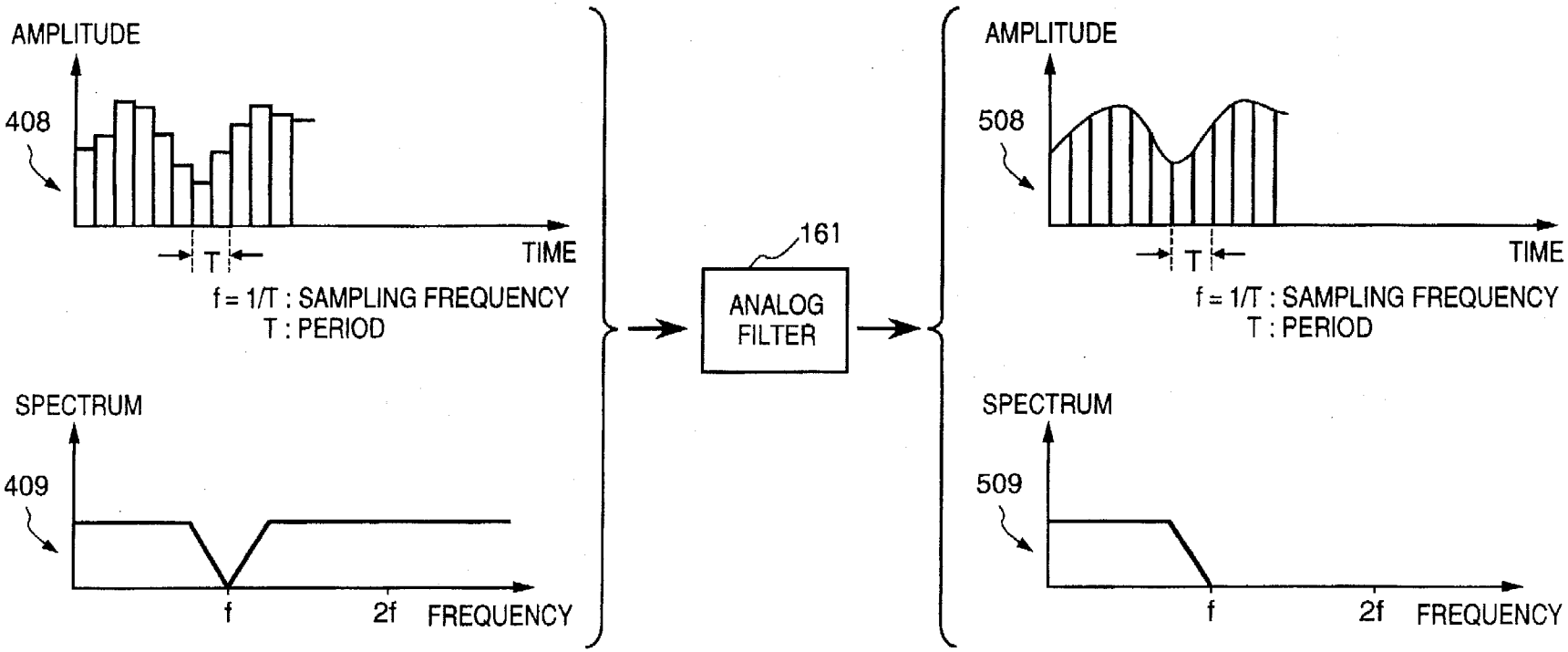
FIG. 29 is a view for explaining the operation of the analog low-pass filter.

FIGS. 27, 28 and 29 are views for explaining the analog low-pass filter 161.

Referring to FIG. 27, a frequency spectrum 501 of the analog low-pass filter 161 exhibits a characteristic which attenuates frequency components higher than the frequency f.

Referring to FIG. 28, an analog speech signal 404 when synthetic speech is to be output at the normal speed is passed through the analog filter 161 and output as an analog signal 504. Reference numeral 505 denotes the frequency spectrum of this analog signal 504, which indicates a correct analog signal from which unnecessary high-frequency noise components, higher than the frequency f/2, are removed.

Referring to FIG. 29, an analog signal 508 is obtained by passing the analog signal 408, which is used to output synthetic speech at the double speed, through the analog filter 161. Reference numeral 509 denotes the frequency spectrum of the analog signal 508, from which unnecessary high-frequency noise components higher than the frequency f, are removed. That is, the analog signal 508 is a correct analog signal for outputting synthetic speech at the double speed.

In step S27, the analog signal obtained by passing through the analog low-pass filter 161 is output as a speech signal.

According to the fourth embodiment as described above, synthetic speech can be output at the double speed. Consequently, the recording time when, for example, recording is to be performed for a cassette tape recorder, can be reduced by one half, and this reduces the work time.

Generally, the current situation is that rule speech synthesizers are neither compact nor light in weight; a personal computer or a host computer such as a workstation performs speech synthesis and outputs synthetic speech from an attached loudspeaker or from a terminal at hand through a telephone line. Therefore, it is not possible to carry a rule speech synthesizer and do some work while listening to the output synthetic speech from the synthesizer. The common approach is to record the output synthetic speech from a rule speech synthesizer into, e.g., a cassette tape recorder, carry the cassette tape recorder, and do the work while listening to the speech played back from the cassette tape recorder. This method requires a considerable time to be consumed in the recording. According to the fourth embodiment, however, it is possible to significantly reduce this recording time.

Note that the present invention can be applied to the system comprising either a plurality of units or a single unit. It is needless to say that the present invention can be applied to the case which can be attained by supplying programs to the system or the apparatus.

According to the third embodiment as described previously, the number of frames can be held constant with respect to a change in the production speed of synthetic speech. This makes it possible to prevent degradation in the tone quality at high speeds and suppress a drop in the processing speed and an increase in the required capacity of a memory at low speeds.

It is also possible to change the speech speed in units of frames.

Furthermore, the present invention can be applied to a system comprising either a plurality of units or a single unit. It is needless to say that the present invention can be applied to the case which can be attained by supplying programs which execute the process defined by the present system or invention.

As many apparently widely different embodiments of the present invention can be made without departing from the spirit and scope thereof, it is to be understood that the invention is not limited to the specific embodiments thereof except as defined in the claims.

What is claimed is:

1. A speech synthesizer for outputting a speech signal by coupling phonemes constituted by one or a plurality of frames having a phoneme vowel-consonant combination parameter (VcV, cV, or V) of a speech waveform, comprising:

storage means for storing expansion degrees, each of which indicates a degree of expansion or compression to which a frame is expanded or compressed in accordance with a production speed of synthetic speech, in a one-to-one correspondence with the frames;

determining means for determining a time length of each frame on the basis of the production speed of synthetic speech and the corresponding expansion degree;

first generating means for generating a parameter in each frame on the basis of the time length determined by said determining means; and second generating means for generating a speech signal of each frame by using the parameter generated by said first generating means.

2. The synthesizer according to claim 1, further comprising setting means for setting a time interval between beat synchronization points on the basis of the production speed of the synthetic speech, wherein said determining means determines the time length of each frame on the basis of the beat synchronization point time interval set by said setting means and the corresponding expansion degree.

3. The synthesizer according to claim 2, wherein said setting means sets the beat synchronization point time interval, which is obtained on the basis of the production speed of the synthetic speech, for each of a time length of a vowel stationary part and a time length of a non-vowel stationary part, and said determining means determines the time length of a frame which belongs to the vowel stationary part on the basis of the time interval of the vowel stationary part, and determines the time length of a frame which belongs to the non-vowel stationary part on the basis of the time interval of the non-vowel stationary part.

4. The synthesizer according to claim 3, wherein said setting means determines the time length of the vowel stationary part on the basis of a beat synchronization point time interval after expansion or compression and the type of the vowel stationary part.

5. The synthesizer according to claim 2, wherein each frame is constituted by a plurality of sampling data at predetermined intervals, and said first generating means includes means for generating a pitch scale, which changes at a predetermined rate for each sampling, on the basis of the set beat synchronization point time interval.

6. The synthesizer according to claim 1, wherein said storage means stores, as the expansion degrees, degrees of expansion or compression to each of which a time interval, between change points where acoustic changes exist, is expanded or compressed in accordance with the production speed of synthetic speech, in a one-to-one correspondence with the frames.

7. The synthesizer according to claim 1, wherein said first generating means includes means for generating a pitch scale with which a level of accent linearly changes in the time length determined by said determining means.

8. The synthesizer according to claim 7, wherein the time length used by said first generating means is an interval between beat synchronization points.

9. The synthesizer according to claim 1, wherein said first generating means includes means for generating a pitch scale with which a pitch of a produced voice linearly changes in the time length determined by said determining means.

10. The synthesizer according to claim 9, wherein the time length used by said first generating means is an interval between beat synchronization points.

11. The synthesizer according to claim 1, wherein the frames before being expanded or compressed in accordance with the speech production speed have respective unique time lengths.

12. A speech synthesizer comprising:

synthesizing means for synthesizing a digital speech signal by sequentially coupling phonemes in the form of phoneme vowel-consonant combination parameters (VcV, cV, or V) and a sound source signal;

frequency multiplying means for multiplying a sampling frequency of the synthetic digital speech signal;

converting means for converting the digital speech signal into an analog signal with the sampling frequency multiplied by said frequency multiplying means; and output means for causing said converting means to convert the digital speech signal processed by said frequency multiplying means into an analog signal and outputting the resulting synthetic speech signal, when the synthetic speech is to be output at a normal speech production speed, and causing said converting means to convert the digital speech signal synthesized by said synthesizing means into an analog signal and outputting the resulting synthetic speech signal, when the synthetic speech is to be output by multiplying the speech production speed.

13. A speech synthesis method for outputting a speech signal by coupling phonemes constituted by one or a plurality of frames having a phoneme vowel-consonant combination parameter (VcV, cV, or V) of a speech waveform, comprising:

a storage step of storing expansion degrees, each of which indicates a degree of expansion or compression to which a frame is expanded or compressed in accordance with a production speed of synthetic speech, in a one-to-one correspondence with the frames;

a determining step of determining a time length of each frame on the basis of the production speed of synthetic speech and the corresponding expansion degree;

a first generating step of generating a parameter in each frame on the basis of the time length determined by the determining step; and a second generating step of generating a speech signal of each frame by using the parameter generated by the first generating step.

14. The method according to claim 13, further comprising the setting step of setting a time interval between beat synchronization points on the basis of the production speed of the synthetic speech, wherein the determining step determines the time length of each frame on the basis of the beat synchronization point time interval set by the setting step and the corresponding expansion degree.

15. The method according to claim 14, wherein the setting step sets the beat synchronization point time interval, which is obtained on the basis of the production speed of the synthetic speech, for each of a time length of a vowel stationary part and a time length of a non-vowel stationary part, and the determining step determines the time length of a frame which belongs to the vowel stationary part on the basis of the time interval of the vowel stationary part, and determines the time length of a frame which belongs to the non-vowel stationary part on the basis of the time interval of the non-vowel stationary part.

16. The method according to claim 15, wherein the setting step determines the time length of the vowel stationary part on the basis of a beat synchronization point time interval after expansion or compression and the type of the vowel stationary part.

17. The method according to claim 14, wherein each frame is constituted by a plurality of sampling data at predetermined intervals, and the first generating step includes the substep of generating a pitch scale, which changes at a predetermined rate for each sampling, on the basis of the beat synchronization point time interval.

18. The method according to claim 13, wherein the storage step stores, as the expansion degrees, degrees of expansion or compression to each of which a time interval, between change points where acoustic changes exist, is expanded or compressed in accordance with the production speed of synthetic speech, in a one-to-one correspondence with the frames.

19. The method according to claim 13, wherein the first generating step includes the substep of generating a pitch scale with which a level of accent linearly changes in the time length determined by the determining step.

20. The method according to claim 19, wherein the time length used in the first generating step is an interval between beat synchronization points.

21. The method according to claim 13, wherein the first generating step includes the substep of generating a pitch scale with which a pitch of a produced voice linearly changes in the time length determined by the determining step.

22. The method according to claim 21, wherein the time length used in the first generating step is an interval between beat synchronization points.

23. The method according to claim 13, wherein the frames before being expanded or compressed in accordance with the speech production speed have respective unique time lengths.

24. A speech synthesis method comprising:

a synthesizing step of synthesizing a digital speech signal by sequentially coupling phonemes in the form of phoneme vowel-consonant combination parameters (VcV, cV, or V) and a sound source signal;

a frequency multiplying step of multiplying a sampling frequency of the synthetic digital speech signal;

a converting step of converting the digital speech signal into an analog signal with the sampling frequency multiplied by the frequency multiplying step; and an outputting step of causing the converting step to convert the digital speech signal processed by the frequency multiplying step into an analog signal and outputting the resulting synthetic speech signal, when the synthetic speech is to be output at a normal speech production speed, and causing the converting step to convert the digital speech signal synthesized by the synthesizing step into an analog signal and outputting the resulting synthetic speech signal, when the synthetic speech is to be output by multiplying the speech production speed.

25. A computer usable medium having computer readable program code means embodied therein for causing a computer comprising a speech synthesizer to output a speech signal by coupling phonemes constituted by one or a plurality of frames having a phoneme vowel-consonant combination parameter (VcV, cV, or V) of a speech waveform, said medium comprising:

first computer readable program code means for causing said computer to store expansion degrees in storage means, each of which indicates a degree of expansion or compression to which a frame is expanded or compressed in accordance with a production speed of synthetic speech, in a one-to-one correspondence with the frames;

second computer readable program code means for causing said computer to determine a time length of each frame on the basis of the production speed of synthetic speech and the corresponding expansion degree with determining means;

third computer readable program code means for causing said computer to generate a parameter in each frame on the basis of the time length determined by said determining means with first generating means; and fourth computer readable program code means for causing said computer to generate a speech signal of each frame by using the parameter generated by said first generating means with said second generating means.

26. The medium according to claim 25, further comprising fifth computer readable program code means for causing said computer to set a time interval between beat synchronization points on the basis of the production speed of the synthetic speech with setting means, wherein said second computer readable program code means causes said determining means to determine the time length of each frame on the basis of the beat synchronization point time interval set by said setting means and the corresponding expansion degree.

27. The medium according to claim 26, wherein said fifth computer readable program code means causes said setting means of said computer to set the beat synchronization point time interval, which is obtained on the basis of the production speed of the synthetic speech, for each of a time length of a vowel stationary part and a time length of a non-vowel stationary part, and said second computer readable program code means causes said determining means to determine the time length of a frame which belongs to the vowel stationary part on the basis of the time interval of the vowel stationary part, and to determine the time length of a frame which belongs to the non-vowel stationary part on the basis of the time interval of the non-vowel stationary part.

28. The medium according to claim 27, wherein said fifth computer readable program code means causes said setting means to determine the time length of the vowel stationary part on the basis of a beat synchronization point time interval after expansion or compression and the type of the vowel stationary part.

29. The medium according to claim 26, wherein each frame is constituted by a plurality of sampling data at predetermined intervals, and said third computer readable program code means causes said first generating means to generate a pitch scale, which changes at a predetermined rate for each sampling, on the basis of the set beat synchronization point time interval.

30. The medium according to claim 25, wherein said first computer readable program code means causes said storage means to store, as the expansion degrees, degrees of expansion or compression to each of which a time interval, between change points where acoustic changes exist, is expanded or compressed in accordance with the production speed of synthetic speech, in a one-to-one correspondence with the frames.

31. The medium according to claim 25, wherein said third computer readable program code means causes said first generating means to include means for generating a pitch scale with which a level of accent linearly changes in the time length determined by said determining means.

32. The medium according to claim 31, wherein the time length used by said first generating means is an interval between beat synchronization points.

33. The medium according to claim 25, wherein said third computer readable program code means causes said first generating means to generate a pitch scale with which a pitch of a produced voice linearly changes in the time length determined by said determining means.

34. The medium according to claim 33, wherein the time length used by said first generating means is an interval between beat synchronization points.

35. The medium according to claim 25, wherein the frames before being expanded or compressed in accordance with the speech production speed have respective unique time lengths.

36. A computer usable medium having computer readable program code means embodied therein for causing the computer to synthesize speech with a speech synthesizer, said medium comprising:

first computer readable program code means for causing said computer to synthesize a digital speech signal by sequentially coupling phonemes in the form of phoneme vowel-consonant combination parameters (VcV, cV, or V) and a sound source signal with a speech synthesizer;

second computer readable program code means for causing said computer to multiply a sampling frequency of the synthetic digital speech signal using frequency multiplying means;

third computer readable program code means for causing said computer to convert the digital speech signal into an analog signal with the sampling frequency multiplied by said frequency multiplying means with converting means; and fourth computer readable program code means for causing said converting means to convert the digital speech signal processed by said frequency multiplying means into an analog signal and outputting the resulting synthetic speech signal with output means, when the synthetic speech is to be output at a normal speech production speed, and for causing said converting means to convert the digital speech signal synthesized by said synthesizing means into an analog signal and outputting the resulting synthetic speech signal with output means, when the synthetic speech is to be output by multiplying the speech production speed.

* * * * *

UNITED STATES PATENT AND TRADEMARK OFFICE

CERTIFICATE OF CORRECTION

PATENT NO. : 5,682,502
DATED : October 28, 1997
INVENTOR(S) : Mitsuru OHTSUKA et al.

It is certified that error appears in the above-identified patent and that said Letters Patent is hereby corrected as shown below:

ON THE COVER PAGE

Item [75] Inventors:

"Yohohama" should read --Yokohama--.

SHEET 8 OF THE DRAWINGS

In Figure 8:

"syncronization" (both occurrences) should read --synchronization--.

Column 1:

Line 28, ""A·KE"" should read --"A·KE".--.

Column 2:

Line 28, "has" should read --has as--.

UNITED STATES PATENT AND TRADEMARK OFFICE

CERTIFICATE OF CORRECTION

PATENT NO. : 5,682,502
DATED : October 28, 1997
INVENTOR(S) : Mitsuru OHTSUKA et al.

It is certified that error appears in the above-identified patent and that said Letters Patent is hereby corrected as shown below:

Column 4:

Line 49, "with a" should read --with the--.
Line 50, "or the" should read --of a--.

Column 5:

Line 63, "$\delta+1$" should read --$\delta+1$.--.

Column 8:

Line 28, "$(N_m\text{-}N_g)$" should read --$(N_m\text{-}N_g)$.--; and
Line 34, "$P_d$" should read --$P_d$.--.

Column 13:

Line 57, "embodiment" should read --embodiment,--.

UNITED STATES PATENT AND TRADEMARK OFFICE

CERTIFICATE OF CORRECTION

PATENT NO. : 5,682,502
DATED : October 28, 1997
INVENTOR(S) : Mitsuru OHTSUKA et al.

It is certified that error appears in the above-identified patent and that said Letters Patent is hereby corrected as shown below:

Column 16:

Line 58, "components" should read --components,--.

Signed and Sealed this

Twenty-sixth Day of May, 1998

*Attest:*

Bruce Lehman

BRUCE LEHMAN

*Attesting Officer*

*Commissioner of Patents and Trademarks*